US012612869B2

(12) United States Patent
Taylor et al.

(10) Patent No.: US 12,612,869 B2
(45) **Date of Patent: *Apr. 28, 2026**

(54) SELF-CONTAINED COMPRESSION BRAKE CONTROL MODULE FOR INTEGRATED ROCKER ARM ENGINE BRAKING AND METHODS

(71) Applicant: Pacbrake Company, Blaine, WA (US)

(72) Inventors: Kody Taylor, Surrey (CA); Peter Stec, Vancouver (CA)

(73) Assignee: PACBRAKE COMPANY, Blaine, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/085,202

(22) Filed: Mar. 20, 2025

(65) Prior Publication Data

US 2025/0215816 A1 Jul. 3, 2025

Related U.S. Application Data

(63) Continuation-in-part of application No. 18/765,655, filed on Jul. 8, 2024, now abandoned, which is a (Continued)

(51) Int. Cl.
*F01L 13/06* (2006.01)
*F01L 1/18* (2006.01)
(Continued)

(52) U.S. Cl.
CPC ..... *F01L 13/06* (2013.01); *F01L 1/181* (2013.01); *F01L 1/2411* (2013.01); *F01L 1/267* (2013.01); *F01L 1/46* (2013.01); *F01L 13/065* (2013.01)

(58) Field of Classification Search
CPC . F01L 13/06; F01L 13/065; F01L 1/18; F01L 1/181; F01L 1/2411; F01L 1/267;
(Continued)

(56) References Cited

U.S. PATENT DOCUMENTS 8,272,363 B2 9/2012 Meneely
11,149,659 B2 10/2021 Stec
(Continued)

*Primary Examiner* — Loren C Edwards
(74) *Attorney, Agent, or Firm* — CALDERON SAFRAN & WRIGHT P.C.

(57) ABSTRACT

A compression-release engine brake system for operating at least one exhaust valve of an engine during an engine braking operation. The brake system comprises a lost motion exhaust rocker assembly and a dual stage hydraulic solenoid valve. The exhaust rocker assembly includes an exhaust rocker arm and a compression brake control module (CBCM). The CBCM maintains the at least one exhaust valve open when in the engine braking operation. The CBCM includes a casing, an actuation piston disposed outside the casing so as to define an actuation piston cavity, a reset check valve, and a compression brake actuator disposed in the casing. The actuation piston reciprocates relative to the casing. The compression brake actuator includes a control piston that engages the check valve when deactivated so as to unlock the actuation piston cavity and disengages from the check valve when activated so as to lock the actuation piston cavity.

19 Claims, 9 Drawing Sheets

Related U.S. Application Data continuation of application No. 18/211,890, filed on Jun. 20, 2023, now Pat. No. 12,031,462.

(60) Provisional application No. 63/353,890, filed on Jun. 21, 2022.

(51) Int. Cl.
*F01L 1/24* (2006.01)
*F01L 1/26* (2006.01)
*F01L 1/46* (2006.01)

(58) Field of Classification Search
CPC ..... F01L 1/46; F01L 2001/34426; F01L 2001/3443
See application file for complete search history.

(56) References Cited

U.S. PATENT DOCUMENTS

| | | | | |
|---|---|---|---|---|
| 12,031,462 | B2 * | 7/2024 | Taylor | F01L 1/181 |
| 2019/0309664 | A1 * | 10/2019 | Batcheller | F01L 1/181 |
| 2020/0182098 | A1 * | 6/2020 | McCarthy, Jr. | F01L 1/24 |
| 2021/0156319 | A1 * | 5/2021 | Stec | F02D 13/04 |
| 2024/0360778 | A1 | 10/2024 | Taylor | |

* cited by examiner

SELF-CONTAINED COMPRESSION BRAKE CONTROL MODULE FOR INTEGRATED ROCKER ARM ENGINE BRAKING AND METHODS

CROSS-REFERENCE TO RELATED APPLICATION AND CLAIM TO PRIORITY

This Application is a Continuation-in-Part of U.S. patent application Ser. No. 18/765,655, filed Jul. 8, 2024, which is a continuation of U.S. patent application Ser. No. 18/211,890 filed Jun. 20, 2023, now U.S. Pat. No. 12,031,462, which claims priority to U.S. Provisional Patent Application No. 63/353,890 filed Jun. 21, 2022 by Taylor et al., the complete disclosures of which are hereby incorporated herein by reference in its entirety and to which priority is claimed.

BACKGROUND OF THE INVENTION

1. Field of the Invention

The present invention relates to compression-release brake systems for internal combustion engines in general and, more particularly, to a self-contained compression-release brake control module for a compression-release engine brake system of an internal combustion engine and methods of using the self-contained compression-release brake control module for a compression-release engine brake system.

2. Description of the Related Art

For internal combustion engines (IC engine), especially diesel engines of large trucks, engine braking is an important feature for enhanced vehicle safety. Consequently, the diesel engines in vehicles, particularly large trucks, are commonly equipped with compression-release engine brake systems (or compression-release retarders) for retarding the engine (and thus, the vehicle as well) in order to slow the truck. The compression release engine braking provides significant braking power in a braking mode of operation. For this reason, the compression-release engine brake systems have been in North America since the 1960's and gained widespread acceptance.

The typical compression-release engine brake system opens an exhaust valve(s) just prior to Top Dead Center (TDC) at the end of a compression stroke. This creates a blow-down of the compressed cylinder gas and the energy accumulated during compression is not reclaimed. The result is engine braking, or retarding, power. A conventional compression-release engine brake system has substantial costs associated with the hardware required to open the exhaust valve(s) against the extremely high load of the compressed cylinder charge. Valve train components must be designed and manufactured to operate reliably at both high mechanical loading and engine speeds. Also, the sudden release of the highly compressed gas comes with a high level of noise. In some areas, typically urban areas, engine brake use is not permitted because the existing compression-release engine brake systems open the valves quickly at high compression pressure near the TDC compression and produces high engine valve train loads and a loud sound. It is the loud sound that has resulted in prohibition of engine compression release brake usage in certain urban areas.

Typically, the compression-release engine brake systems up to this time are unique, i.e., custom designed and engineered to a particular engine make and model. The design, prototype fabrication, bench testing, engine testing and field testing typically require twenty four (24) months to complete prior to sales release. Accordingly, both the development time and cost have been an area of concern.

Exhaust brake systems can be used on engines where compression release loading is too great for the valve train. The exhaust brake mechanism consists of a restrictor element mounted in the exhaust system. When this restrictor is closed, backpressure resists the exit of gases during the exhaust cycle and provides a braking function. This system provides less braking power than a compression release engine brake, but also at less cost. As with a compression release brake, the retarding power of an exhaust brake falls off sharply as engine speed decreases. This happens because the restriction is optimized to generate maximum allowable backpressure at rated engine speed. The restriction is simply insufficient to be effective at the lower engine speeds.

U.S. Pat. No. 8,272,363 describes a self-contained compression brake control module (CBCM) for controlling exhaust valve motion, primarily for, but not limited to, the purpose of engine retarding. The CBCM described in U.S. Pat. No. 8,272,363 is often required to operate with a significant axial offset between a longitudinal axis of the CBCM and a longitudinal valve axis of an exhaust valve it acts upon, as illustrated in FIGS. 2A-2C of the U.S. Pat. No. 8,272,363. The CBCM described in U.S. Pat. No. 8,272,363 comprises an actuation piston retaining ring and seal engaging the same bore within a single casing of the CBCM. This causes an increased diameter requirement in a portion of the bore due to assembly concerns with passing a seal past a retaining ring groove. The CBCM of U.S. Pat. No. 8,272,363 utilizes a casing that contains the actuation piston while still requiring a support housing, adding diameter to the overall assembly. These contributors to a required offset generate a side force acting on the actuation piston of the CBCM, which may cause a risk of wear and/or jamming of the actuation piston in its bore. Practical applications for the CBCM often dictate both a reduction in overall height and diameter in order to fit within existing engine packages without interference or undesired changes to other components. It is therefore advantageous to be able to reduce the size of the CBCM module, to both better center it over the loading generated by the exhaust valve, and to package it into tighter space constraints.

Similarly, U.S. Pat. No. 11,149,659, which is incorporated herein by reference, describes a self-contained, compact hydraulic compression brake control module, which is used to selectively modify the lift and phase angle of an exhaust valve. The brake control module of U.S. Pat. No. 11,149,659 is disclosed as fixed in position relative to the cylinder head of the diesel engine.

Compression-release engine brake systems of modern engine often integrate key engine brake components into a rocker arm, which is therefore positioned movably relative to a cylinder head of a diesel engine, such as lost motion compression-release engine brake systems and dedicated cam compression-release engine brake systems. Lost motion compression-release engine brake systems are compression-release engine brake systems that position components into an exhaust rocker arm, while dedicated cam compression-release engine brake systems are compression-release engine brake systems that position components into a dedicated engine brake rocker arm, which is independent of intake and exhaust rocker arms.

While known compression-release engine brake systems have proven to be acceptable for various vehicular engine applications, such devices are nevertheless susceptible to improvements that may enhance their performance and cost. With this in mind, a need exists to develop improved compression-release engine brake systems that advance the art, such as a self-contained compression brake control module for a compression-release brake system of an internal combustion engine capable of performing "dedicated cam" engine braking and both "lost motion" and "dedicated cam" engine braking. Such systems should be easier to assemble, be more robust and compact when assembled, while enhancing performance, improving functionality and significantly reducing the development time and cost of the compression-release engine brake system.

SUMMARY OF INVENTION

According to a first aspect of the present invention, a compression-release brake system operates at least one exhaust valve of an internal combustion engine during a compression-release engine braking operation. The compression-release system comprises a lost motion exhaust rocker assembly and a dual stage hydraulic solenoid valve. The lost motion exhaust rocker assembly comprises an exhaust rocker arm. A self-contained compression brake control module is mounted to the exhaust rocker arm and is operatively coupled to the at least one exhaust valve so as to control lift and phase angle of the at least one exhaust valve. The compression brake control module maintains the at least one exhaust valve open during the compression stroke of the internal combustion engine when in the compression-release engine braking operation. The compression brake control module comprises a hollow casing, including a single-piece body mounted in the exhaust rocker arm, and a hollow actuation piston disposed outside the casing. The casing defines an internal actuator cavity, with a hollow inner portion extending away from the internal actuator cavity. The hollow actuation piston is disposed in the exhaust rocker arm so as to receive the inner portion. The actuation piston defines a variable volume hydraulic actuation piston cavity between the casing and the actuation piston, with the actuation piston reciprocating relative to the inner portion between an extended position and a collapsed position. The actuation piston is configured to engage the at least one exhaust valve when in the extended position. The compression brake control module further comprises a connecting passage arranged in the casing to fluidly connect the actuation piston cavity to the internal actuator cavity. A reset check valve is arranged between the connecting passage and the actuation piston cavity. A compression brake actuator includes a control piston exposed to ambient pressure and configured to reciprocate between an extended position and a retracted position, and a control piston spring biases the control piston toward the extended position in which the control piston engages and opens the reset check valve solely via biasing force of the control piston spring. The reset check valve is configured to hydraulically lock the actuation piston cavity when the pressure of hydraulic fluid within the actuation piston cavity exceeds the pressure of hydraulic fluid in a supply port formed in the casing. The reset check valve is biased closed via a biasing spring. The compression brake actuator is slidably arranged in the internal actuator cavity to control the reset check valve. The control piston spring biases the control piston toward the extended position so as to unlock the actuation piston cavity and fluidly connect the actuation piston cavity to the supply port. The dual stage hydraulic solenoid valve is configured for controlling hydraulic pressure in the compression brake control module. The dual stage hydraulic solenoid valve includes a valve body having an intake port, an outlet port and an exhaust port. A solenoid coil is disposed in the valve body, with an armature rectilinearly reciprocating within the solenoid coil and a solenoid pin rectilinearly reciprocating within valve body and operatively associated with the armature. An intake valve is disposed between the intake port and the outlet port, and a pressure regulating exhaust valve is disposed between the outlet port and the exhaust port. The actuation piston includes an inner peripheral surface defining a groove, with a retaining ring mounted to the groove. The inner portion includes an outer peripheral surface defining an inner stopping surface. The retaining ring is configured to engage the inner stopping surface to stop movement of the actuation piston relative to the casing when the actuation piston reaches the extended position and the retaining ring engages the inner stopping surface. Moreover, the pressurized hydraulic fluid supplied to the valve body through the intake port is regulated to flow through both the outlet port and the exhaust port via the pressure regulating exhaust valve when the solenoid coil is in a de-energized state. When the solenoid coil is in an energized state, the pressure regulating exhaust valve is closed and the intake valve is opened so as to supply the pressurized hydraulic fluid only to the outlet port.

According to a second aspect of the invention, a method of operating the compression-release brake system according to the first aspect of the present invention includes opening the dual stage hydraulic solenoid valve to supply full inlet pressure hydraulic fluid from the source of pressurized hydraulic fluid through the center conduit and the brake fluid passageway to the compression brake control module to extend the actuation piston and hydraulically close the reset check valve during a braking operation mode of the engine. The dual stage hydraulic solenoid valve is closed to supply low inlet pressure hydraulic fluid from the source of pressurized hydraulic fluid through the center conduit and the brake fluid passageway to the compression brake control module to open the reset check valve, for thereby retracting the actuation piston during positive power operation mode of the engine.

Other aspects of the invention, including systems, assemblies, subassemblies, units, engines, processes, and the like which constitute part of the invention, will become more apparent upon reading the following detailed description of the exemplary embodiments.

BRIEF DESCRIPTION OF THE DRAWINGS

Additional objects and advantages of the invention will become apparent from a study of the following specification when viewed in light of the accompanying drawings, wherein.

DETAILED DESCRIPTION OF PREFERRED EMBODIMENT(S)

Figure 1:
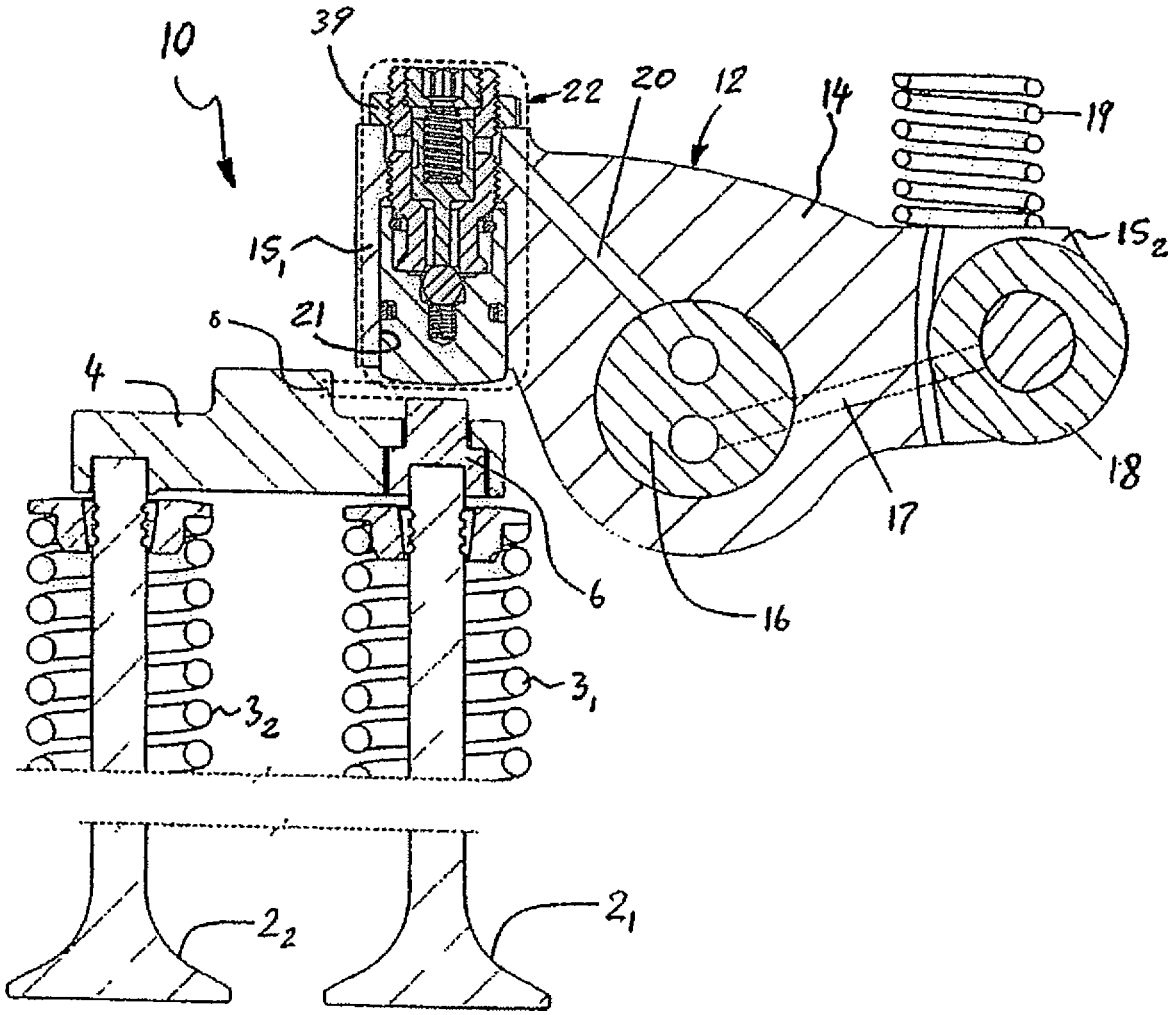
FIG. 1 is a sectional view of a dedicated compression-release engine brake rocker assembly according to a first exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiment(s) is intended to be read in connection with the accompanying drawings, which are to be considered part of the entire written description. In the description, relative terms such as "horizontal," "vertical," "up," "down," "upper", "lower", "right", "left", "top" and "bottom", "front" and "rear", "inwardly" and "outwardly" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. The words "smaller" and "larger" refer to relative size of elements of the apparatus of the present invention and designated portions thereof. Additionally, the word "a" and "an" as used in the claims means "at least one" and the word "two" as used in the claims means "at least two".

FIG. 1 depicts a compression-release engine brake system 10, according to a first exemplary embodiment of the present invention, for an internal combustion (IC) engine. The compression-release engine brake system 10 is a dedicated cam compression-release engine brake system (or dedicated cam engine brake system). Preferably, the IC engine is a four-stroke diesel engine, conventionally comprising a cylinder block including one or more cylinders (not shown). Each cylinder is provided with two intake valves (not shown), and first and second exhaust valves $\mathbf{2}_1$ and $\mathbf{2}_2$, and a valve train for lifting (opening) and closing the exhaust valves $\mathbf{2}_1$ and $\mathbf{2}_2$. Each of the exhaust valves $\mathbf{2}_1$ and $\mathbf{2}_2$ is provided with a return spring exerting a closing force on the associated exhaust valve to urge the exhaust valves $\mathbf{2}_1$ and $\mathbf{2}_2$ into a closed position. The return springs of the first and second exhaust valves $\mathbf{2}_1$ and $\mathbf{2}_2$ (also known as exhaust valve springs) are designated by reference numerals $\mathbf{3}_1$ and $\mathbf{3}_2$, respectively.

The exhaust valves $\mathbf{2}_1$ and $\mathbf{2}_2$ are substantially structurally identical in this embodiment. In view of these similarities, and in the interest of simplicity, the following discussion will sometimes use a reference numeral without a letter to designate both substantially identical valves. For example, the reference numeral 2 will sometimes be used when generically referring to each of the exhaust valves $\mathbf{2}_1$ and $\mathbf{2}_2$ rather than reciting both reference numerals. It will be appreciated that each engine cylinder may be provided with one or more intake valve(s) and/or exhaust valve(s), although two exhaust valves are shown in FIG. 1. The IC engine is capable of performing both positive power operation (normal engine cycle) and engine brake operation (engine brake cycle). The compression-release brake system 10 operates in a compression brake (or brake-on) mode during the engine brake operation and a compression brake deactivation (or brake-off) mode during the positive power operation.

The dedicated cam compression-release brake system 10 comprises a dedicated engine brake rocker assembly 12 added to each engine cylinder in addition to conventional intake and exhaust rocker assemblies, respectively. The dedicated engine brake rocker assembly 12 operates only one of the exhaust valves $\mathbf{2}_1$ and $\mathbf{2}_2$. Correspondingly, the dedicated engine brake rocker assembly 12 according to the first exemplary embodiment of the present invention includes a dedicated engine brake rocker arm 14 pivotally mounted about an engine brake rocker shaft 16 and provided to open only the first exhaust valve $\mathbf{2}_1$ through a thru-pin (or valve bridge pin) 6 extending through exhaust valve bridge 4. The valve bridge pin 6 is reciprocatingly mounted to the exhaust valve bridge 4 and is slidably movable relative to the exhaust valve bridge 4 to allow the first exhaust valve $\mathbf{2}_1$ to be operated in the brake-on mode.

The dedicated engine brake rocker arm 14, as best shown in FIG. 1, has two ends: a driving (first distal) end $\mathbf{15}_1$ controlling the first exhaust valve $\mathbf{2}_1$, and a driven (second distal) end $\mathbf{15}_2$ adapted to contact a dedicated engine brake cam (not shown). The dedicated engine brake rocker arm 14 includes a dedicated engine brake cam follower 18 mounted to the driven end $\mathbf{15}_2$ of the engine brake rocker arm 14, as best shown in FIG. 1. According to the exemplary embodiment, the dedicated engine brake cam follower 18 is, for example, a cylindrical roller rotatably mounted to the driven end $\mathbf{15}_2$ of the engine brake rocker arm 14. The engine brake cam follower 18 is provided to contact the dedicated engine brake cam. The engine brake cam follower 18 receives input motion from the dedicated engine brake cam. Thus, the engine brake cam follower 18 defines a camshaft interface. Alternatively, the camshaft interface can be adapted to suit engine requirements, for example with a ball or socket for a push-rod type interface.

The engine brake rocker shaft 16 is configured to deliver continuous lubrication to the engine brake cam follower 18 via a lubrication conduit 17 formed in the engine brake rocker arm 14.

As further illustrated in FIG. 1, the dedicated engine brake rocker assembly 12 comprises a self-contained compression brake control module (or CBCM) 22 for selectively controlling the lift and phase angle of one of the exhaust valves $\mathbf{2}_1$ and $\mathbf{2}_2$, specifically of the first exhaust valve $\mathbf{2}_1$. As shown in FIG. 1, the CBCM 22 is located above the thru-pin 6. In the first exemplary embodiment, the CBCM 22 controls exhaust valve motion primarily for, but not limited to, the purpose of engine retarding. Specifically, the CBCM 22 is primarily for selectively controlling the lift and phase angle of the first exhaust valve $\mathbf{2}_1$, which functions as a brake exhaust valve. Also, the dedicated engine brake rocker assembly 12 employs the CBCM 22 to remove valve lash δ from the brake valve train to allow activation of the engine brake in order to open a single exhaust valve $\mathbf{2}_1$ or both exhaust valves $\mathbf{2}_1$ and $\mathbf{2}_2$ at a fast rate of rise with maximum allowable lift near top dead center (TDC) of a compression stroke. Late opening with rapid rate of valve lift assures high peak cylinder pressure and quick cylinder blow-down during the beginning of the expansion stroke and consequently a high degree of engine brake retarding power from the diesel engine.

The engine brake cam (not shown) is configured to drive (or pivot) the engine brake rocker arm 14 towards the exhaust valve bridge 4 near TDC of the compression stroke. The CBCM 22 is also provided for selectively controlling valve lash (initial spacing) δ of the first exhaust valve $\mathbf{2}_1$, as shown in FIG. 1. The valve lash δ is set between the CBCM 22 and the valve bridge pin 6, preferably by adjustment of the CBCM 22 relative to the engine brake rocker arm 14. Alternatively, equivalent valve lash may be set between the engine brake cam follower 18 and the engine brake cam (not shown). The valve lash δ is set such that when the compression-release brake system 10 is in the brake-off (i.e., deactivated) mode, there is sufficient clearance so that the brake cam motion near TDC is not transferred through to the first exhaust valve $\mathbf{2}_1$.

A biasing force to the engine brake rocker arm 14 is applied to maintain the valve lash δ and keep the engine brake rocker assembly 12 in a de-energized state to avoid "clatter" between the engine brake cam and engine brake cam follower 18. In the first exemplary embodiment shown in FIG. 1, a biasing spring 19 is fixedly positioned relative to the engine cylinder head (not shown), and contacts the driven end $\mathbf{15}_2$ of the engine brake rocker arm 14 such that the biasing (or retaining) force of the spring 19 retains the dedicated engine brake cam follower 18 in contact with the dedicated engine brake cam applied to the driven end $\mathbf{15}_2$ of the engine brake rocker arm 14.

Alternately, the biasing spring 19 may be relocated relative to the dedicated engine brake rocker arm 14, such that the retaining force is applied to bias the engine brake cam follower 18 away from the engine brake cam, and the function of the dedicated engine brake rocker assembly 12 as otherwise disclosed is retained. Further alternatively, a camshaft interface may be adapted to suit engine requirements, for example with a ball or socket for a push-rod type interface. It will be evident to one skilled in the art, that the overhead engine brake cam follower 18 may be substituted with a cam-in-block push tube assembly, and the function of the dedicated engine brake rocker assembly 12 as otherwise disclosed will be retained.

Figure 2A:
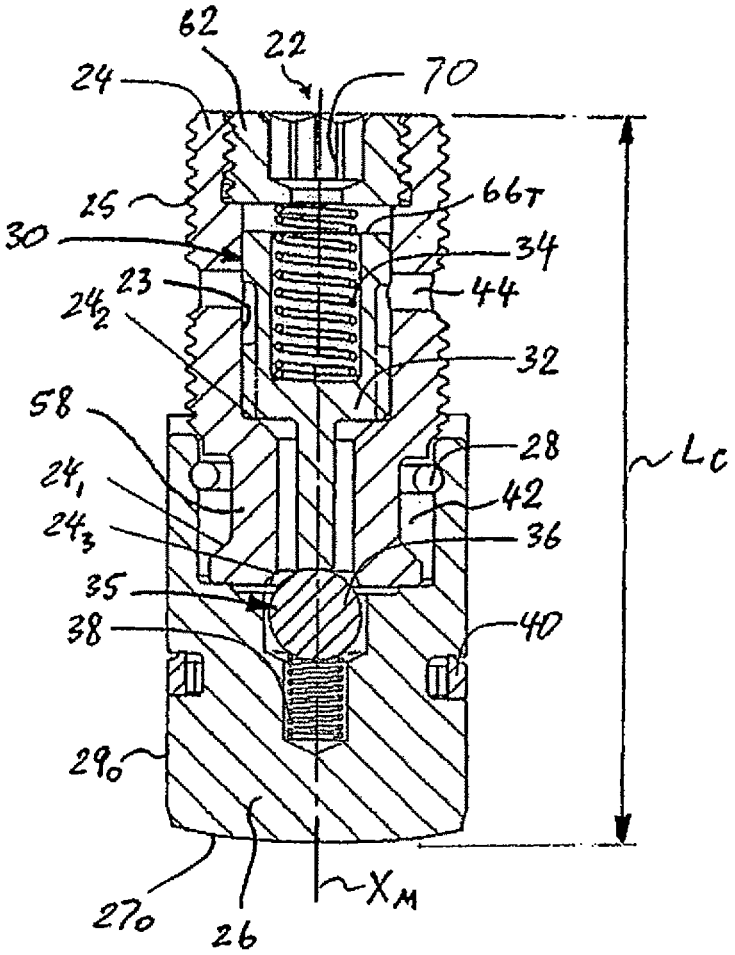
FIG. 2A is a sectional view of a hydraulically actuated compression brake control module of the engine brake rocker assembly according to the first exemplary embodiment of the present invention in a deactivated state.
Figure 2B:
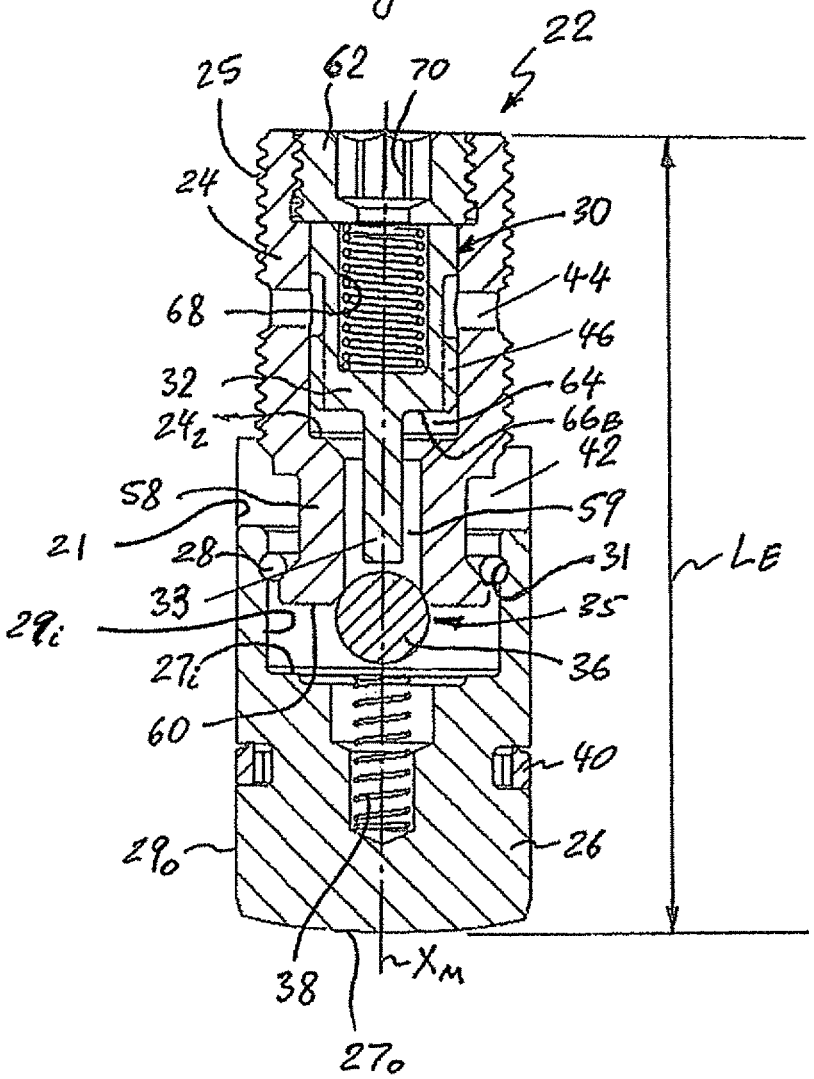
FIG. 2B is a sectional view of the hydraulically actuated compression brake control module of the engine brake rocker assembly according to the first exemplary embodiment in an activated state.
Figure 4A:
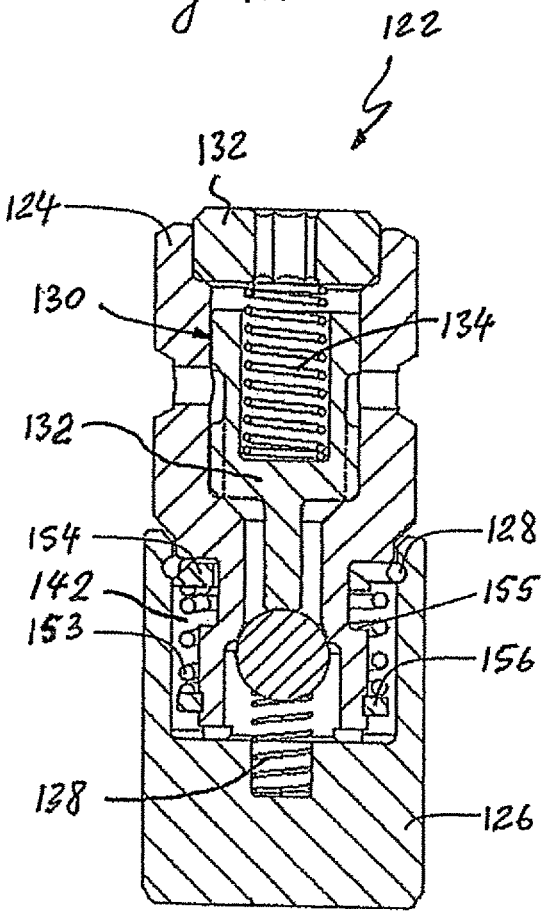
FIG. 4A is a sectional view of a hydraulically actuated compression brake control module of the lost motion compression-release engine brake rocker assembly according to the second exemplary embodiment of the present invention in a deactivated state.
Figure 4B:
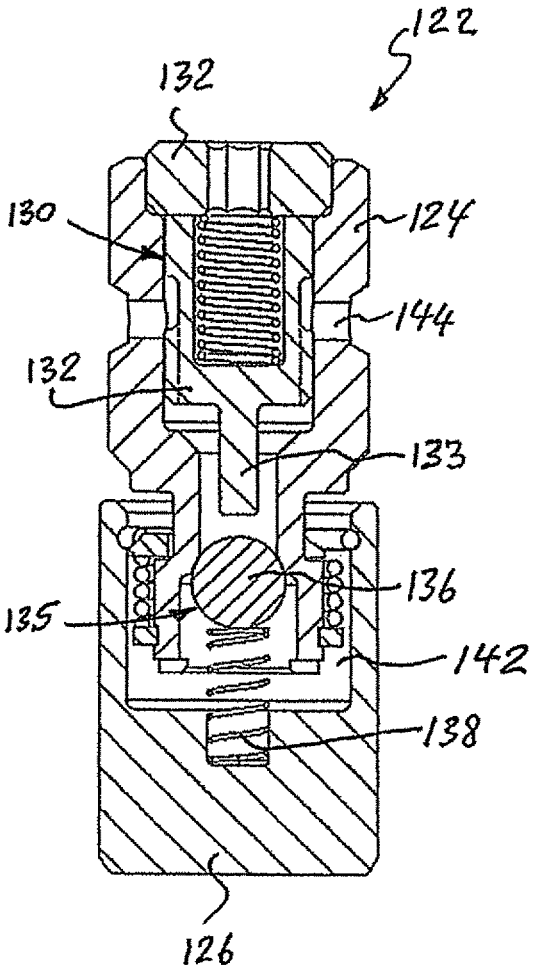
FIG. 4B is a sectional view of the hydraulically actuated compression brake control module of the lost motion compression-release engine brake rocker assembly according to the second exemplary embodiment in an activated state.

The CBCM 22 is a hydraulically actuated compression brake control module, as shown in FIGS. 1-2B. Alternatively, a variation on the CBCM that includes internal spring-return features as shown in FIGS. 4A-4B could be employed.

A compression brake fluid passageway (oil conduit) 20 is provided within the dedicated engine brake rocker arm 14 to provide fluid communication between the hydraulically actuated CBCM 22 and a source 80 of pressurized hydraulic fluid. Preferably, the source 80 of the pressurized hydraulic fluid is an engine oil pump (not shown) of the diesel engine. Correspondingly, in this exemplary embodiment, engine lubricating oil is used as the working hydraulic fluid stored in a hydraulic fluid sump. It will be appreciated that any other appropriate source of the pressurized hydraulic fluid and any other appropriate type of fluid is within the scope of the present invention. The compression brake fluid passageway 20 selectively supplies the pressurized hydraulic fluid from the source to the CBCM 22, so as to switch the CBCM 22 between a deactivated (or brake-off) state (shown in FIG. 2A) when the pressurized hydraulic fluid is not supplied to the CBCM 22, and an activated (or brake-on) state (shown in FIG. 2B) when the pressurized hydraulic fluid is supplied to the CBCM 22. The dedicated engine brake rocker assembly 12 is activated by supplying pressurized hydraulic fluid to the CBCM 22 through the compression brake fluid passageway 20. This causes the CBCM 22 to extend, and to maintain the activated state (extended position) until the pressurized hydraulic fluid is removed (as described in the U.S. Pat. No. 11,149,659). In the brake-on state, the valve lash δ is sufficiently decreased so that the brake cam motion is transferred to the first exhaust valve $\mathbf{2}_1$ via the valve bridge pin 6.

FIGS. 2A and 2B are sectional views of the CBCM 22 in the deactivated and activated state, respectively. In the first exemplary embodiment, illustrated in FIGS. 1-2B, the CBCM 22 is disposed adjacent to the first exhaust valve $\mathbf{2}_1$ and above the valve bridge pin 6. As illustrated in detail in FIGS. 2A and 2B, the CBCM 22 comprises a hollow casing 24 in the form of a cylindrical single-piece hollow body, a hollow actuation piston 26 slidingly mounted to the casing 24, and a retaining ring 28 mounted to the actuation piston 26. Specifically, as best shown in FIGS. 2A and 2B, the retaining ring 28 is disposed inside the actuation piston 26 and mounted in a groove 31 formed on an inner peripheral surface 29*i* of the actuation piston 26.

As further illustrated in FIGS. 1-2B, a cylindrical outer peripheral surface 25 of the casing 24 is at least partially threaded, so as to be threadedly received in an internally partially threaded cylindrical control bore $\mathbf{2}_1$ formed in the driving end $\mathbf{15}_1$ of the engine brake rocker arm 14 (best shown in FIGS. 1-2B). The cylindrical single-piece body 24 includes a unitary, hollow cylindrical inner portion 58. A lock nut 39 (best shown in FIG. 1) is provided to adjustably fasten and non-moveably retain the casing 24 of the CBCM 22 to the driving end $\mathbf{15}_1$ of the dedicated engine brake rocker arm 14, i.e., to lock the casing 24 of the CBCM 22 in position relative to the engine brake rocker arm 14. Thus, the casing 24 of the CBCM 22 is non-movably, i.e., fixedly, mounted to the engine brake rocker arm 14.

More specifically, as illustrated in detail in FIGS. 2A and 2B, the actuation piston 26 is slidingly mounted to the casing 24 for slidingly reciprocating within a non-threaded portion of the cylindrical control bore 21 in the exhaust rocker arm 14 (best shown in FIGS. 2A and 2B) and relative to the casing 24 of the CBCM 22 between a deactivated state (i.e., collapsed (or retracted) position) (shown in FIG. 2A) and an extended position (shown in FIG. 2B). Accordingly, the casing 24 and the actuation piston 26 define a variable volume hydraulic actuation piston cavity (or chamber) 42 therebetween within the cylindrical control bore 21, including between an inner end face 27*i* of the actuation piston 26 and the casing 24.

The CBCM 22 has a longitudinal axis $X_M$, as best shown in FIGS. 2A and 2B. The actuation piston 26 is coaxial with the longitudinal axis $X_M$ of the CBCM 22, as best shown in FIGS. 2A and 2B. An outer end (or contact) face 27*o* of the actuation piston 26 engages the brake exhaust valve $\mathbf{2}_1$ when in the extended position through the valve bridge pin 6 reciprocatingly mounted to the exhaust valve bridge 4. The valve bridge pin 6 is reciprocatingly movable relative to the exhaust valve bridge 4 so as to make the brake exhaust valve $\mathbf{2}_1$ movable relative to the exhaust valve $\mathbf{2}_2$ and the exhaust valve bridge 4.

The actuation piston 26 slidingly reciprocates relative to the casing 24 within a non-threaded portion of the cylindrical control bore 21 in the driving end $\mathbf{15}_1$ of the engine brake rocker arm 14, as best shown in FIGS. 1-2B, between a retracted (or collapsed) position, shown in FIG. 2A, and an extended position, shown in FIG. 2B. An extension limit is defined by the position of the retaining ring 28 in the actuation piston 26 and a retaining ring seat (or inner stopping surface) $\mathbf{24}_1$ formed on the casing 24. The retaining ring 28 is configured to stop movement of the actuation piston 26 such that the actuation piston 26 is in the extended position when the retaining ring 28 engages the inner stopping surface $\mathbf{24}_1$. The length of the CBCM 22 in the extended position (illustrated in FIG. 2B) is $L_E$, while the length of the CBCM 22 in the collapsed position (illustrated in FIG. 2A) is $L_C$, which is smaller than the length $L_E$.

In the exemplary embodiment illustrated in FIG. 1, the CBCM 22 is fixed (i.e., non-movably attached to the rocker arm 14). Specifically, the CBCM 22 is mounted to the exhaust rocker arm 14 and located adjacent to the exhaust valves $\mathbf{2}_1$, $\mathbf{2}_2$. As illustrated in detail in FIGS. 2A-2B, the CBCM 22 comprises a hollow casing in the form of a cylindrical single-piece body 24 including a unitary, hollow cylindrical inner portion 58. The cylindrical single-piece body 24 also defines a cylindrical internal actuator cavity 23.

The CBCM 22 further comprises a hydraulic compression brake actuator 30 mounted within the actuator cavity 23 of the casing 24. The compression brake actuator 30 in turn comprises a control piston 32 slidingly mounted within the casing 24, an end cap 62, and a control piston spring 34 disposed within the casing 24 between the control piston 32 and the end cap 62 to bias the control piston 32 toward the actuation piston 26. As illustrated in FIGS. 2A-2B, the control piston 32 is formed integrally with a control piston pin 33 extending into the cylindrical inner portion 58 of the hollow casing 24. The control piston 32 slidably reciprocates within the casing 24 between an extended position, shown in FIG. 2A, and a retracted position, shown in FIG. 2B, and is biased towards the extended position by the control piston spring 34. Retraction of the control piston 32 is limited by the position of the end cap 62 relative to the casing 24, while extension of the control piston 32 is limited by the position of a control piston seat $\mathbf{24}_2$ within the casing 24. The actuation piston 26 is in the retracted position when the inner end face 27*i* of the actuation piston 26 engages a bottom face 60 of the cylindrical inner portion 58 of the hollow casing 24, as shown in FIG. 2A.

The casing 24 and the control piston 32 define a variable volume actuator chamber 64 within an innermost portion of the cylindrical actuator cavity 23 between an inner end (or bottom) face $\mathbf{66}_B$ of the control piston 32 and the control piston seat $\mathbf{24}_2$ within the casing 24. The bottom face $\mathbf{66}_B$ of the control piston 32 is engageable with the control piston seat $\mathbf{24}_2$ of the control piston 32 when the control piston 32 is in the extended position, as shown in FIG. 2A. An outer end (or top) face $\mathbf{66}_T$ of the control piston 32 is engageable with the end cap 62 of the casing 24 when in the retracted position of the control piston 32, as shown in FIG. 2B. The control piston spring 34 extends between the control piston 32 and the end cap 62 to bias the control piston 32 downwardly toward the retracted position. The control piston 32 is bored in order to form a vent chamber 68 between the control piston 32 and the end cap 62 to receive the control piston spring 34. The vent chamber 68 is subject to ambient pressure through at least one vent port 70 provided in the end cap 62 which exposes the outer end (or top) face 66*T* of the control piston 32 to ambient pressure. The control piston 32 is adapted to reciprocate between the control piston seat $\mathbf{24}_2$ of the casing 24 and the end cap 62.

The CBCM 22 also comprises a reset check (i.e., one-way) valve 35, including a valve member 36, preferably in the form of a spherical ball member, and a biasing valve spring 38. The valve member 36 is biased towards valve seat $\mathbf{24}_3$ in the casing 24 by the biasing valve spring 38. The CBCM 22 further comprises a supply (or inlet) port 44 formed within the casing 24. The supply port 44 is fluidly connected to the brake fluid passageway 20 in the engine brake rocker arm 14, as shown in FIG. 1, to provide pressurized hydraulic fluid from a source of the pressurized hydraulic fluid to the actuation piston cavity 42 through control piston channels 46. Thus, pressurized hydraulic fluid may flow into the inlet port 44 in the casing 24, and through the control piston channels 46 into the internal actuator cavity 23 and the actuation piston cavity 42, in order to cause extension of the actuation piston 26 from the casing 24.

The control piston 32 of the compression brake actuator 30 selectively engages the valve member 36 of the reset check valve 35 when the CBCM 22 is deactivated so as to unlock the actuation piston cavity 42 (as shown in FIG. 2A) and fluidly connect the actuation piston cavity 42 to the supply port 44 of the pressurized hydraulic fluid. When activated, the control piston 32 disengages the valve member 36 so as to lock the actuation piston cavity 42 and fluidly disconnect the actuation piston cavity 42 from the supply port 44 of the pressurized hydraulic fluid, as best shown in FIG. 2B.

According to the exemplary embodiment of the present invention, the CBCM 22 further comprises a hydraulic seal (or sealing device) 40 to limit hydraulic leakage and minimize hydraulic compliance during engine braking. As best shown in FIGS. 2A and 2B, the hydraulic seal 40 is mounted to a smooth outer peripheral surface 290 of the actuation piston 26. The hydraulic seal 40 is disposed between the actuation piston 26 and the cylindrical control bore 21 of the exhaust rocker arm 14 to eliminate piston-to-bore leakage of the pressurized hydraulic fluid. The seal 40 is eliminates oil leakage from the cylindrical control bore 21 of the exhaust rocker arm 14 and holds the actuation piston 26 in the retracted position without an additional return spring. As shown in FIG. 1, the CBCM 22 is threadedly engaged into the driving end $\mathbf{15}_1$ of the engine brake rocker arm 14. As best shown in FIG. 2B, a variable volume actuation piston cavity 42 is defined between the engine brake rocker arm 14, the casing 24 and the actuation piston 26.

The actuation piston cavity 42 in the actuation piston 26 and the internal actuator cavity 23 in the hollow casing 24 are in fluid communication with each other through a connecting passage 59 in the hollow cylindrical inner portion 58 of the hollow casing 24. As illustrated in FIGS. 2A-2B, the control piston pin 33 of the control piston 32 extends into the connecting passage 59 in the hollow cylindrical inner portion 58 of the hollow casing 24 towards the valve member 36 of the reset check valve 35.

In the deactivated state (i.e., depressurized condition) of the CBCM 22, the ball valve member 36 is prevented from interfacing with the valve seat $\mathbf{24}_3$ in the casing 24 by the control piston pin 33. The control piston pin 33 extends into the cylindrical inner portion 58 of the hollow casing 24 toward the valve member 36 of the reset check valve 35.

Depending on the presence of the hydraulic seal 40, the actuation piston 26 is also capable of extending due to the force of the biasing valve spring 38 or due to road vibrations. If the fluid pressure in the supply port 44 is insufficient to lift the control piston 32 into the retracted positon, then the actuation piston 26 will not be capable of supporting a force greater than the force created to extend it. As a consequence, any significant force applied to the outer end face 27*o* of the actuation piston 26 causes the activation piston 32 to retract.

In the deactivated state of the CBCM 22, friction from the hydraulic seal 40 is the sole retention force acting on the actuation piston 26 of FIGS. 2A and 2B. The actuation piston 26 of the CBCM 22 moveably mounted to the oscillating rocker arm 14, according to the present invention, an additional retention force is provided to avoid 'clatter' with the valve bridge 4.

The CBCM 22 is activated by raising the hydraulic pressure in the supply port 44 to a level which causes the control piston 32 to reach its retracted position, as shown FIG. 2B. This in turn allows the valve member 36 to contact the valve seat $\mathbf{24}_3$, forming the one-way (check) valve 35 in the actuation piston cavity 42. Any force applied to the contact face 27*o* of the actuation piston 26 is supported by a further raising of the hydraulic pressure within the actuation piston cavity 42.

The CBCM 22 is de-activated by lowering the hydraulic pressure in the supply port 44 to a level which allows the control piston 32 to move towards the extended position, shown in FIG. 2A. The force must be removed from the contact face 27*o* of the actuation piston 26 before the valve member 36 can be lifted away from the valve seat $\mathbf{24}_3$. Once the valve member 36 is lifted and the control piston 32 fully extended, then the actuation piston 26 can no longer support a significant force. Activation and deactivation of the control module 22 typically is through a switch in the operator's cab, which also causes fuel to be turned off to the engine.

A method of operating an exhaust rocker assembly 12 for operating at least one exhaust valve $\mathbf{2}_1$ of an internal combustion engine during a compression-release engine braking operation is as follows. First, the reset check valve 35 is biased closed when the pressurized hydraulic fluid is supplied from the compression brake fluid passageway 20 to the CBCM 22 to extent the hollow activation piston 26 and hydraulically activate the compression brake actuator 30 during a braking operation mode of the internal combustion engine. Next, the reset check valve 35 is hydraulically biasing closed during a valve brake lift of the at least one exhaust valve $\mathbf{2}_1$. Then, the pressurized hydraulic fluid is stopped to be supplied from the source 80 to the CBCM 22. As a result, the reset check valve 35 is biased open and allows retraction of the hollow activation piston 26 during a positive power operation mode of the engine. Consequently, the at least one exhaust valve $\mathbf{2}_1$ is reset by opening the reset check valve 35 and releasing hydraulic fluid from the actuation piston cavity 42 to close the at least one exhaust valve $\mathbf{2}_1$.

Figure 3:
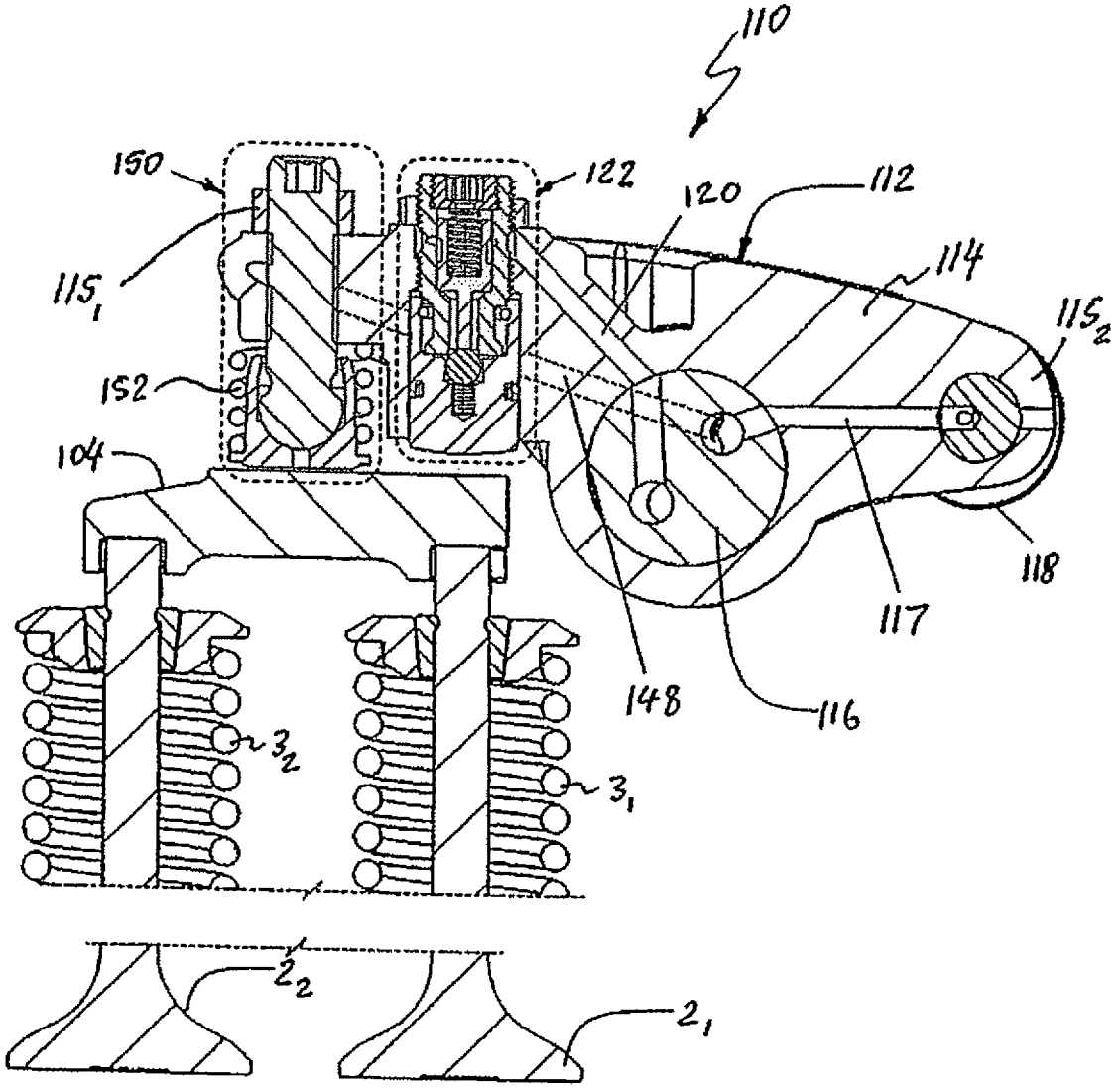
FIG. 3 is a sectional view of a lost motion compression-release engine brake rocker assembly according to a second exemplary embodiment of the present invention.

FIG. 3 depicts a compression-release brake system 110 according to a second exemplary embodiment of the present invention, provided for an internal combustion (IC) engine, such as a diesel engine. Components, which are unchanged from the first exemplary embodiment, are labeled with the same reference characters. Components, which function in the same way as in the first exemplary embodiment depicted in FIGS. 1-2B are designated by the same reference numerals to some of which 100 has been added, sometimes without being described in detail since similarities between the corresponding parts in the two embodiments will be readily perceived by the reader.

The compression-release brake system 110 is a lost motion compression-release engine brake system (or lost motion exhaust rocker arm engine brake system) with automatic hydraulic adjusting and resetting functions. The term "lost motion" identifies a type of rocker arm brake that adds an additional small lift profile to the exhaust cam lobe that opens the exhaust valve(s) near TDC of the compression stroke when excess exhaust valve lash is removed from the valve train. Preferably, the IC engine is a four-stroke diesel engine, conventionally comprising a cylinder block including one or more cylinders (not shown). Each cylinder is provided with two intake valves (not shown), and first (or braking) and second exhaust valves $\mathbf{2}_1$ and $\mathbf{2}_2$, and a valve train for lifting (opening) and closing of the exhaust valves $\mathbf{2}_1$ and $\mathbf{2}_2$. Each of the exhaust valves $\mathbf{2}_1$ and $\mathbf{2}_2$ is provided with a return spring exerting a closing force on the exhaust valves to urge the exhaust valves $\mathbf{2}_1$ and $\mathbf{2}_2$ into the closed position. The return springs of the first and second exhaust valves $\mathbf{2}_1$ and $\mathbf{2}_2$ (also known as exhaust valve springs) are designated by reference numerals $\mathbf{3}_1$ and $\mathbf{3}_2$, respectively.

The exhaust valves $\mathbf{2}_1$ and $\mathbf{2}_2$ are substantially structurally identical in this embodiment. In view of these similarities, and in the interest of simplicity, the following discussion will sometimes use a reference numeral without a letter to designate both substantially identical valves. For example, the reference numeral 2 will be sometimes used when generically referring to each of the exhaust valves $\mathbf{2}_1$ and $\mathbf{2}_2$ rather than reciting all two reference numerals. It will be appreciated that each engine cylinder may be provided with one or more intake valve(s) and/or exhaust valve(s), although two of each is shown in FIG. 3.

The IC engine is capable of performing a positive power operation (normal engine cycle) and an engine brake operation (engine brake cycle). The compression-release brake system 110 operates in a compression brake (or brake-on) mode during the engine brake operation and a compression brake deactivation (or brake-off) mode during the positive power operation.

The lost motion compression-release brake system 110 comprises a conventional intake rocker assembly (not shown) for operating intake valve(s), and a lost motion exhaust rocker assembly 112 for operating at least one of the first exhaust valve $\mathbf{2}_1$ and the second exhaust valve $\mathbf{2}_2$. Moreover, the exhaust rocker assembly 112 is provided with automatic hydraulic adjusting and resetting functions, as herein explained. The lost motion exhaust rocker assembly 112 includes a lost motion exhaust rocker arm 114 pivotally mounted for movement about an engine rocker shaft 116 to open the first and second exhaust valves $\mathbf{2}_1$ and $\mathbf{2}_2$ through an exhaust valve bridge 104. The rocker shaft 116 allows the exhaust rocker arm 114 to transfer camshaft motion to the exhaust valves $\mathbf{2}_1$ and $\mathbf{2}_2$ through the exhaust valve bridge 104, i.e., moving one or both of the exhaust valves $2_1$ and $2_2$ into an open position, which are returned to the closed position by the exhaust valve springs $3_1$ and $3_2$. The lost motion exhaust rocker arm 114, as best shown in FIG. 3, has two ends: a driving (first distal) end $115_1$ controlling the exhaust valves $2_1$ and $2_2$, and a driven (second distal) end $115_2$ adapted to contact an engine brake cam (not shown). The lost motion exhaust rocker arm 114 includes an exhaust cam follower 118 mounted to the driven end $115_2$ of the lost motion exhaust rocker arm 114, as best shown in FIG. 3. The exhaust cam follower 118 is, for example, a cylindrical roller rotatably mounted to the driven end $115_2$ of the exhaust rocker arm 114. The exhaust cam follower 118 contacts an exhaust cam (not shown). The exhaust cam follower 118 receives input motion from the exhaust cam. Thus, the exhaust cam follower 118 defines a camshaft interface. The rocker shaft 116 delivers continuous lubrication to the exhaust cam follower 118 via a lubrication conduit 117 formed in the exhaust rocker arm 114. Alternatively, the camshaft interface can be adapted to suit engine requirements, for example with a ball or socket for a push-rod type interface.

As further illustrated in FIG. 3, the lost motion rocker assembly 112 comprises a self-contained compression brake control module (or CBCM) 122 for selectively controlling the lift and phase angle of one or both of the exhaust valves $2_1$ and $2_2$, and a slider screw assembly 150. As shown in FIG. 3, the CBCM 122 is placed above the exhaust valve bridge 104 and the braking exhaust valve $2_1$, while the slider screw assembly 150 is centered above the valve bridge 104. The rocker shaft 116 selectively delivers pressurized hydraulic fluid to the CBCM 122 via a brake fluid passageway 120 formed in the exhaust rocker arm 114, and delivers continuous lubrication to the slider screw assembly 150 via a lubrication conduit 148 formed in the exhaust rocker arm 114.

The exhaust cam (not shown) pivots the exhaust rocker arm 114 towards the valve bridge 104 to open and close the exhaust valves $2_1$ and $2_2$ during a normal exhaust stroke. After the conclusion of normal exhaust motion, the exhaust cam profile moves away from the exhaust cam follower 118, allowing the exhaust cam follower 118 to move (rotate) away from the valve bridge 104. The slider screw assembly 150 lengthens under the force of slider spring 152 to pivot the exhaust rocker arm 114 towards the exhaust cam, maintaining the exhaust cam follower 118 in contact with the exhaust cam as it moves away.

The exhaust cam drives the exhaust rocker arm 114 towards the valve bridge 104 near TDC of the compression stroke. This oscillating motion of the exhaust rocker arm 114 is not transmitted to the exhaust valves $2_1$ and $2_2$ during the normal (or positive power) engine operation (or the brake-off mode of the lost motion compression-release engine brake system 110), i.e., it is "lost" to the valves.

The lost motion compression-release engine brake system 110 is energized by supplying pressurized hydraulic fluid to the brake fluid passageway 120 and the CBCM 122. The pressurized fluid causes the CBCM 122 to extend during the 'away' portion of the cycle, i.e., when the driving end $115_1$ of the exhaust rocker arm 114 with the CBCM 122 pivots away from the exhaust valve bridge 104. The CBCM 122 maintains the extended position until the pressurized fluid is removed (as described in the U.S. Pat. No. 11,149,659). The CBCM 122 extends sufficiently far that the 'lost' motion is then 'found' by the braking exhaust valve $2_1$, and the braking exhaust valve $2_1$ is opened near TDC compression stroke.

Alternatively, the overhead exhaust cam follower 118 may be substituted with a cam-in-block push tube assembly, and the function of the lost motion compression-release engine brake system 110 as otherwise disclosed will be retained. It will also be evident that a valve bridge pin through the valve bridge 104, as shown in FIG. 3, may be implemented to control contact pressures at the interface between the braking exhaust valve $2_1$, the valve bridge 104, and the CBCM 122 without compromise of function as disclosed.

FIGS. 4A and 4B are sectional views of the hydraulically actuated CBCM 122 of the second exemplary embodiment in the deactivated and activated state, respectively.

The CBCM 122 comprises a reset check (i.e., one-way) valve 135 including a valve member 136, preferably in the form of a spherical ball member, and a biasing valve spring 138. The CBCM 122 also comprises a hollow casing 124 in the form of a cylindrical single-piece hollow body, an actuation piston 126 slidingly mounted to the casing 124, and a retaining ring 128 mounted to the actuation piston 126.

FIGS. 4A and 4B show an actuation piston bias mechanism including an actuation piston bias spring 153 disposed in an actuation piston cavity 142, an actuation bias washer 154, and an actuation bias retaining ring 156. The cylindrical single-piece casing 124 receives the actuation bias washer 154 and the actuation bias retaining ring 156 such that the actuation piston bias spring 153 is disposed therebetween. The actuation piston 126 is biased towards the extended position by the actuation piston bias spring 153. An extension limit of the actuation piston 126 is defined by the position of retaining ring 128 mounted to the actuation piston 126, and the actuation bias washer 154 in the actuation piston 126, and a washer ring seat 155 in the casing 124. In the deactivated state, the biasing valve spring 138 creates a minimum force threshold which must be overcome to move the actuation piston 126 toward the retracted position (shown in FIG. 4A), resisting extension due to low hydraulic pressure of the hydraulic fluid in the brake fluid passageway 120, motion of the exhaust rocker arm 114, and external vibrations.

Figure 5:
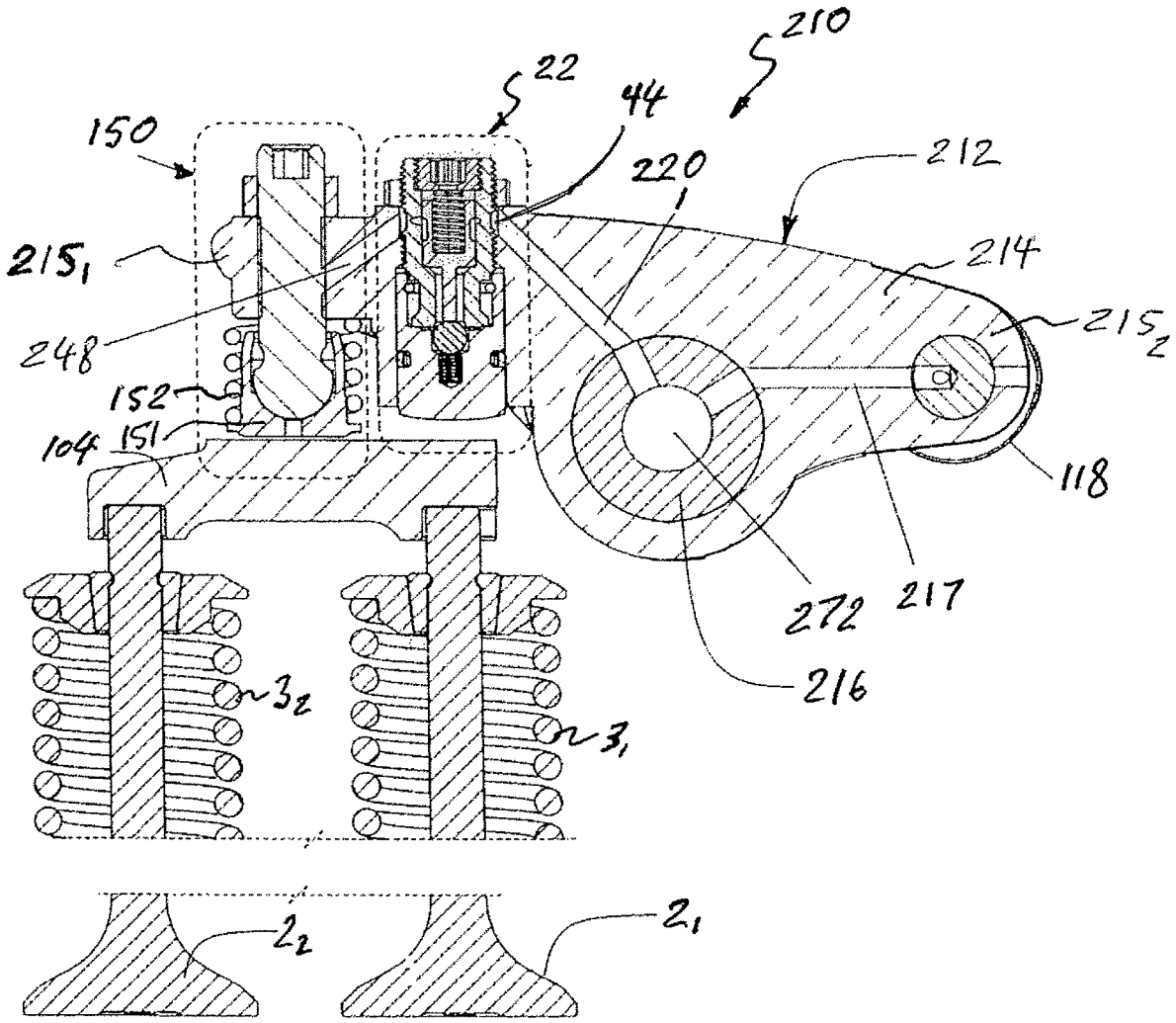
FIG. 5 is a sectional view of a lost motion compression-release engine brake rocker assembly according to a third exemplary embodiment of the present invention.

FIG. 5 depicts a compression-release brake system 210 according to a third exemplary embodiment of the present invention for an internal combustion (IC) engine, such as a diesel engine. Components which are unchanged from the second exemplary embodiment are labeled with the same reference characters. Components which function in the same way as in the second exemplary embodiment depicted in FIGS. 2A-4B are designated by the same reference numerals, to some of which 100 has been added, sometimes without being described in detail since similarities between the corresponding parts in the two embodiments will be readily perceived by the reader.

The compression-release brake system 210 is a lost motion compression-release engine brake system (or lost motion exhaust rocker arm engine brake system) with automatic hydraulic adjusting and resetting functions. The term "lost motion" identifies a type of rocker arm brake that adds an additional small lift profile to the exhaust cam lobe that opens the exhaust valve(s) near TDC of the compression stroke when excess exhaust valve lash is to be removed from the valve train. Preferably, the IC engine is a four-stroke diesel engine, conventionally comprising a cylinder block including one or more cylinders (not shown). Each cylinder is provided with two intake valves (not shown), and first (or braking) and second exhaust valves $2_1$ and $2_2$, and a valve train for lifting (opening) and closing the exhaust valves $2_1$ and $2_2$. Each of the exhaust valves $2_1$ and $2_2$ engages a return spring exerting a closing force on the exhaust valves to urge the exhaust valves $2_1$ and $2_2$ into the closed position. The return springs of the first and second exhaust valves $2_1$ and $2_2$ (also known as exhaust valve springs) are designated by reference numerals $3_1$ and $3_2$, respectively.

The exhaust valves $2_1$ and $2_2$ are substantially structurally identical in this embodiment. In view of these similarities and in the interest of simplicity, the following discussion will sometimes use a reference numeral without a letter to designate both substantially identical valves. For example, the reference numeral 2 will be sometimes used when generically referring to each of the exhaust valves $2_1$ and $2_2$ rather than reciting both reference numerals. It will be appreciated that each engine cylinder may be provided with one or more intake valve(s) and/or exhaust valve(s), although two of each is shown in FIG. 3 and generally is standard.

The IC engine is capable of performing a positive power operation (normal engine cycle) and an engine brake operation (engine brake cycle). The compression-release brake system 210 operates in the compression brake (or brake-on) mode during engine brake operation and the compression brake deactivation (or brake-off) mode during positive power operation.

The lost motion compression-release brake system 210 comprises a conventional intake rocker assembly (not shown) for operating the intake valve(s), and a lost motion exhaust rocker assembly 212 for operating at least one of the first exhaust valve $2_1$ and the second exhaust valve $2_2$. Moreover, the exhaust rocker assembly 212 is provided with automatic hydraulic adjusting and resetting functions, as herein explained. The lost motion exhaust rocker assembly 212 includes a lost motion exhaust rocker arm 214 pivotally mounted for movement about an engine rocker shaft 216 to open the first and second exhaust valves $2_1$ and $2_2$, such as through an exhaust valve bridge 104.

Figure 8:
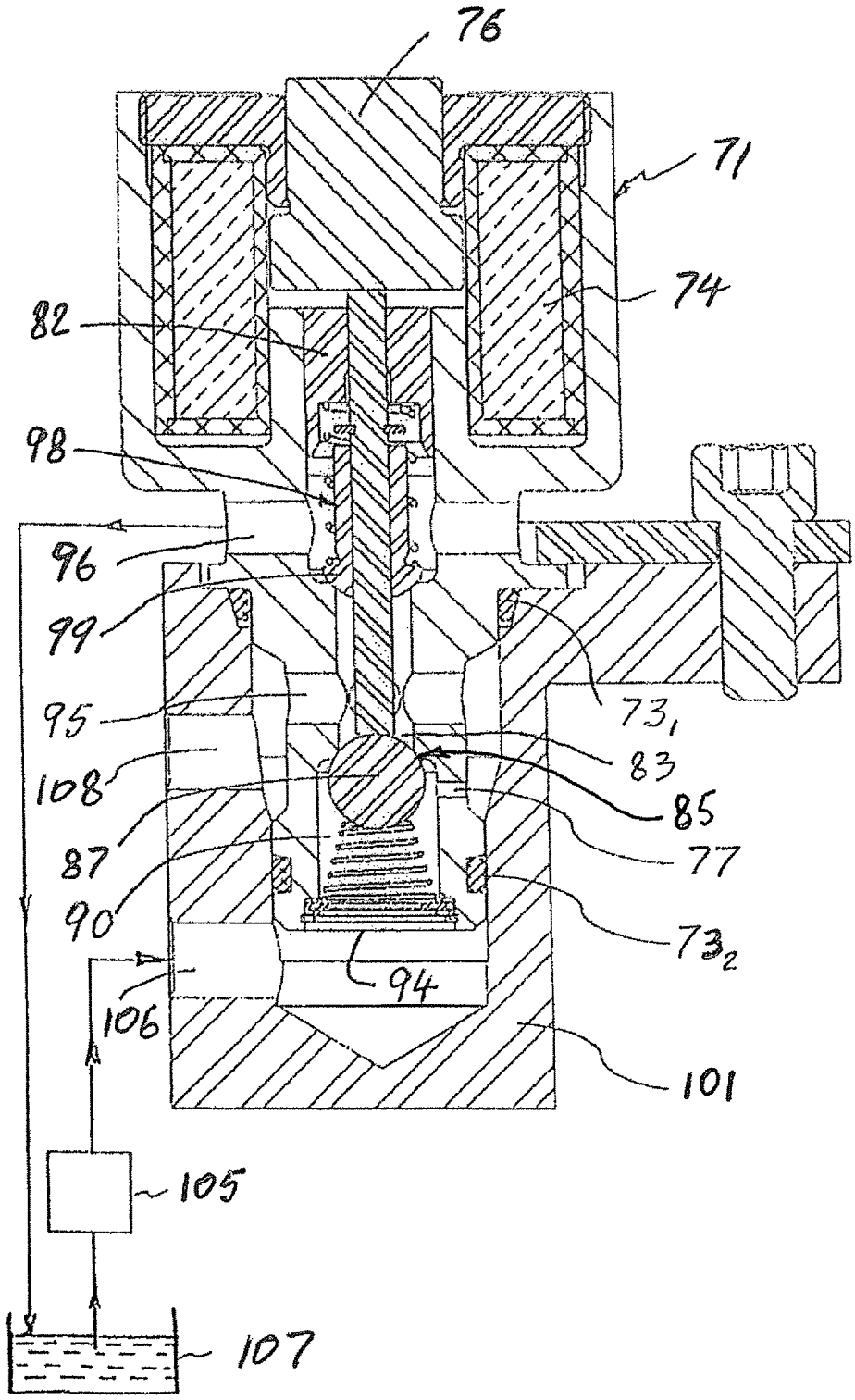
FIG. 8 is a sectional view of the dual stage hydraulic solenoid valve of FIG. 6 installed in a hydraulic manifold.

The engine rocker shaft 216 has a center conduit 272 fluidly connected to a source 105 of pressurized hydraulic fluid, as best shown in FIG. 8. Preferably, the source 105 of the pressurized hydraulic fluid is the oil pump of the diesel engine. Correspondingly, in this exemplary embodiment, engine lubricating oil is used as the working hydraulic fluid stored in a hydraulic fluid sump. It will be appreciated that any other appropriate source of pressurized hydraulic fluid and any other appropriate type of fluid is within the scope of the present invention.

The rocker shaft 216 is formed with a lubrication conduit 217 and a brake fluid passageway 220, as shown in FIG. 5. Moreover, the center conduit 272 through the engine rocker shaft 216 is in continuous fluid communication with the lubrication conduit 217 and the brake fluid passageway 120. The rocker shaft 216 delivers continuous lubrication to the exhaust cam follower 118 via the lubrication conduit 217 in the exhaust rocker arm 214.

The brake fluid passageway 220 selectively supplies pressurized hydraulic fluid from the source to the CBCM 22, in order to switch the CBCM 22 between a deactivated (or brake-off) state (shown in FIG. 2A) when the pressurized hydraulic fluid is not supplied to the CBCM 22 and an activated (or brake-on) state (shown in FIG. 2B) when pressurized hydraulic fluid is supplied to the CBCM 22. The lost motion exhaust rocker assembly 212 is activated by supplying pressurized hydraulic fluid to the CBCM 22 through the compression brake fluid passageway 220. Supplying pressurized fluid causes the actuation piston 26 of the CBCM 22 to extend, and to maintain the activated state (extended position) until the pressure of the hydraulic fluid is reduced sufficiently to allow the check valve control piston 132 to open the check valve 136. By reducing the oil pressure (turning off the solenoid), the reset spring 134 can overcome the upward force on the actuation piston 126 caused by oil pressure in the actuator chamber 64. The control piston 132 moves down and opens the ball 136 (as described in the U.S. Pat. No. 11,149,659). In the brake-on state, the valve lash is sufficiently decreased so that the brake cam motion is transferred to the first exhaust valve $2_1$ via the exhaust valve bridge 104, as is known in the art.

The rocker shaft 216 allows the exhaust rocker arm 214 to transfer camshaft motion to the exhaust valves $2_1$ and $2_2$ through the exhaust valve bridge 104, i.e., moving one or both of the exhaust valves $2_1$ and $2_2$ into an open position and which are then returned to the closed position by the exhaust valve springs $2_1$ and $2_2$. The lost motion exhaust rocker arm 214, as best shown in FIG. 5, has two ends: a driving (first distal) end $215_1$ controlling the exhaust valves $2_1$ and $2_2$, and a driven (second distal) end $215_2$ adapted to contact an engine brake cam (not shown). The lost motion exhaust rocker arm 214 includes an exhaust cam follower 118 mounted to the driven end $215_2$ of the lost motion exhaust rocker arm 214, as best shown in FIG. 5. The exhaust cam follower 118 is, for example, a cylindrical roller rotatably mounted to the driven end $215_2$ of the exhaust rocker arm 214. The exhaust cam follower 118 contacts an exhaust cam (not shown) and is configured to drive motion of (oscillate) the exhaust rocker arm 214 towards the valve bridge 104, to open and close the exhaust springs $3_1$ and $3_2$ during the normal exhaust stroke. After the conclusion of normal exhaust motion, the exhaust cam profile moves away from the exhaust cam follower 118, allowing the exhaust rocker arm 214 to move (rotate) away from the exhaust valve bridge 104. The exhaust cam drives the exhaust rocker arm 214 back towards the exhaust valve bridge 104 near TDC compression stroke. This 'away and back' oscillated motion is not transmitted to the valves $2_1$ and $2_2$ during normal engine (brake off) operation, i.e., it is motion 'lost' to the valves.

The exhaust cam follower 118 receives input motion from the exhaust cam. Thus, the exhaust cam follower 118 defines a camshaft interface. The rocker shaft 116 delivers continuous lubrication to the exhaust cam follower 118 via the lubrication conduit 117 in the exhaust rocker arm 114. Alternatively, the camshaft interface can be adapted to suit engine requirements, for example with a ball or socket for a push-rod type interface.

As further illustrated in FIG. 5, the lost motion rocker assembly 212 comprises a self-contained compression brake control module (or CBCM) 22 for selectively controlling the lift and phase angle of one or both of the exhaust valves $2_1$ and $2_2$, and a slider screw assembly 150. As shown in FIG. 5, the CBCM 22 is located above the exhaust valve bridge 104 and the braking exhaust valve $2_1$, while the slider screw assembly 150 is centered above the valve bridge 104. The rocker shaft 216 selectively delivers pressurized hydraulic fluid to the CBCM 22 via a brake fluid passageway 220 n the exhaust rocker arm 214, and delivers continuous lubrication to the slider screw assembly 150 via a lubrication channel 248 in the driven end $215_2$ of the lost motion exhaust rocker arm 214. The lubrication channel 248 is fluidly connected to the brake fluid passageway 220 through the supply port 44 of the CBCM 22.

The brake fluid passageway 220 selectively supplies pressurized hydraulic fluid from the source 105 to the slider screw assembly 150 and to the CBCM 22, in order to switch the CBCM 22 between a deactivated (or brake-off) state (shown in FIG. 2A) when the pressurized hydraulic fluid is supplied at a sufficiently low level to the CBCM 22 and an activated (or brake-on) state (shown in FIG. 2B) when the pressurized hydraulic fluid is supplied at a sufficiently high level to the CBCM 22. The lost motion rocker assembly 212 is activated by supplying pressurized hydraulic fluid to the CBCM 22 through the compression brake fluid passageway 220. This causes the CBCM 22 to extend and to maintain the activated state (extended position) until the pressurized hydraulic fluid is reduced sufficiently. In the brake-on state, the valve lash is sufficiently decreased so that the brake cam motion is transferred to the first exhaust valve $\mathbf{2}_1$ via the valve bridge 104. Only one exhaust valve is opened in this configuration shown in FIG. 5. The valve bridge 104 tips down. Alternatively, a thru-bridge pin can be used. Both options allow the one exhaust valve $\mathbf{2}_1$ to open while the outer valve $\mathbf{2}_2$ remains closed.

As shown in FIG. 5, the brake fluid passageway 220 and the lubrication channel 248 are in continuous fluid connection via the inlet port 44 and the the internal actuator cavity 23 in the casing 24 of the CBCM 22. The pressurized fluid from the variable pressure source 105 is supplied to the center conduit 272 of the engine rocker shaft 216. The engine rocker shaft 216 is configured to fluidly connect the center conduit 272 to the lubrication conduit 217 and the brake fluid passageway 220. At a regulated relatively low pressure regulated by dual stage hydraulic solenoid valve 71, the engine rocker shaft 216 delivers lubricating oil to the exhaust cam follower 118 and slider screw assembly 150 via the connected lubrication conduit 217, the brake fluid passageway 220, and the lubrication channel 248.

The lost motion compression-release engine brake system 210 is energized by supplying pressurized hydraulic fluid to the CBCM 22 through the brake fluid passageway 220 from the source 105 of pressurized hydraulic fluid upon actuation of dual stage hydraulic solenoid valve 71. The pressurized fluid causes the actuation piston 26 of CBCM 22 to extend from the casing 24 during a portion of the engine brake cycle, i.e., when the driving end $\mathbf{215}_1$ of the exhaust rocker arm 214 with the CBCM 22 pivots away from the exhaust valve bridge 104. The actuation piston 26 of CBCM 22 maintains the extended position until the pressurized fluid is reduced sufficiently. The actuation piston 26 of CBCM 22 extends sufficiently far that the 'lost' motion is then 'found' by the braking exhaust valve $\mathbf{2}_1$, and the braking exhaust valve $\mathbf{2}_1$ is opened near a TDC compression stroke.

It will be evident to those skilled in the art that the overhead exhaust cam follower 118 may be substituted with a cam-in-block push tube assembly, and the function of the engine brake as otherwise disclosed will be retained. It will also be evident that the valve bridge through a thru-pin (such as the exhaust valve bridge 4 shown in FIG. 1) may be implemented to control contact pressures at the interface between the brake valve $\mathbf{2}_1$, the valve bridge 4, and the CBCM 22 without compromise of function as disclosed.

The first and second embodiments of the present invention disclose compression-release engine brake systems that include a dedicated oil circuit supplied to the engine brake module and selectively pressurized to cause the compression-release engine brake system to activate. This solution may be difficult to implement in small engines where two oil circuits in the rocker arm shaft may be difficult or costly to manufacture. As a consequence, the third embodiment uses the center conduit 272 in the exhaust rocker arm 214 as a common oil supply line, which performs two functions: 1) carrying lubricating oil, e.g., engine oil, to the center conduit 272 of the rocker arm 214, and then to the exhaust cam follower 118 and the slider screw assembly 150, which requires lubrication at a swivel foot 151; and 2) providing a pressurized hydraulic fluid, such as lubricating oil, to hydraulically actuate the CBCM 22 to start a compression-release engine braking operation. Manufacture of the third embodiment is thus somewhat easier than manufacture of the first and second embodiments.

Figure 6:
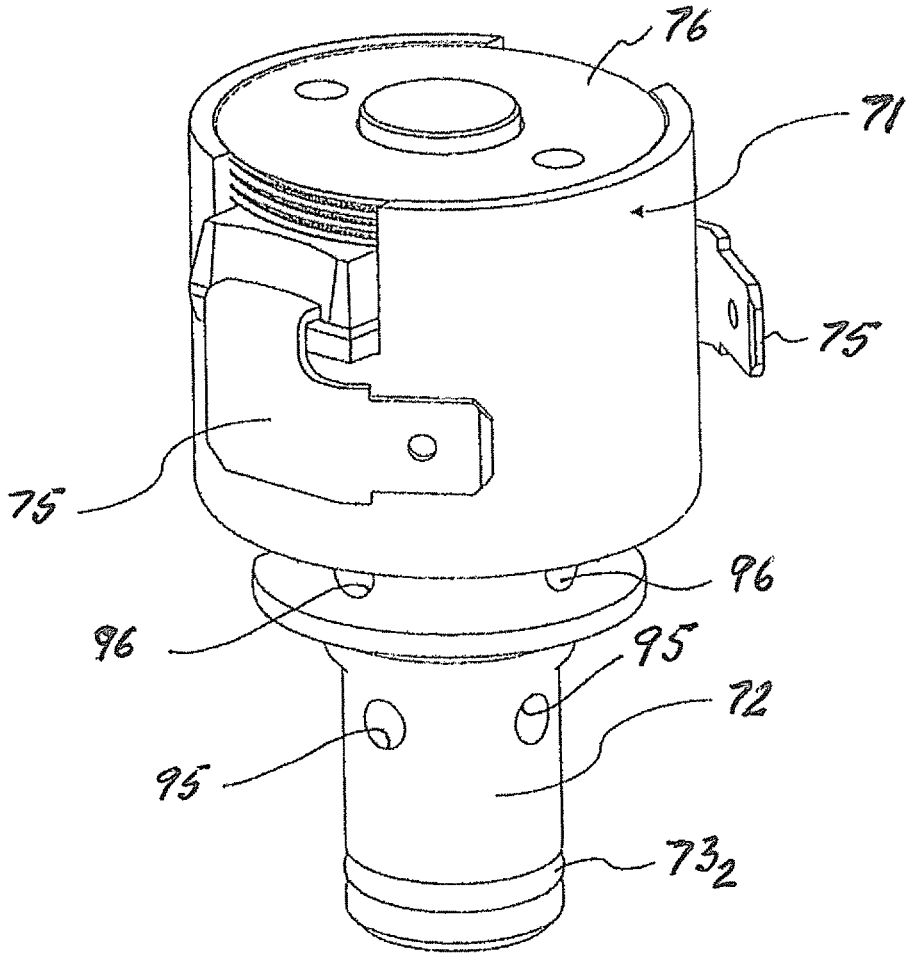
FIG. 6 is a perspective view of a dual stage hydraulic solenoid valve of the rocker arm compression-release engine brake system according to the third exemplary embodiment of the present invention.
Figure 7:
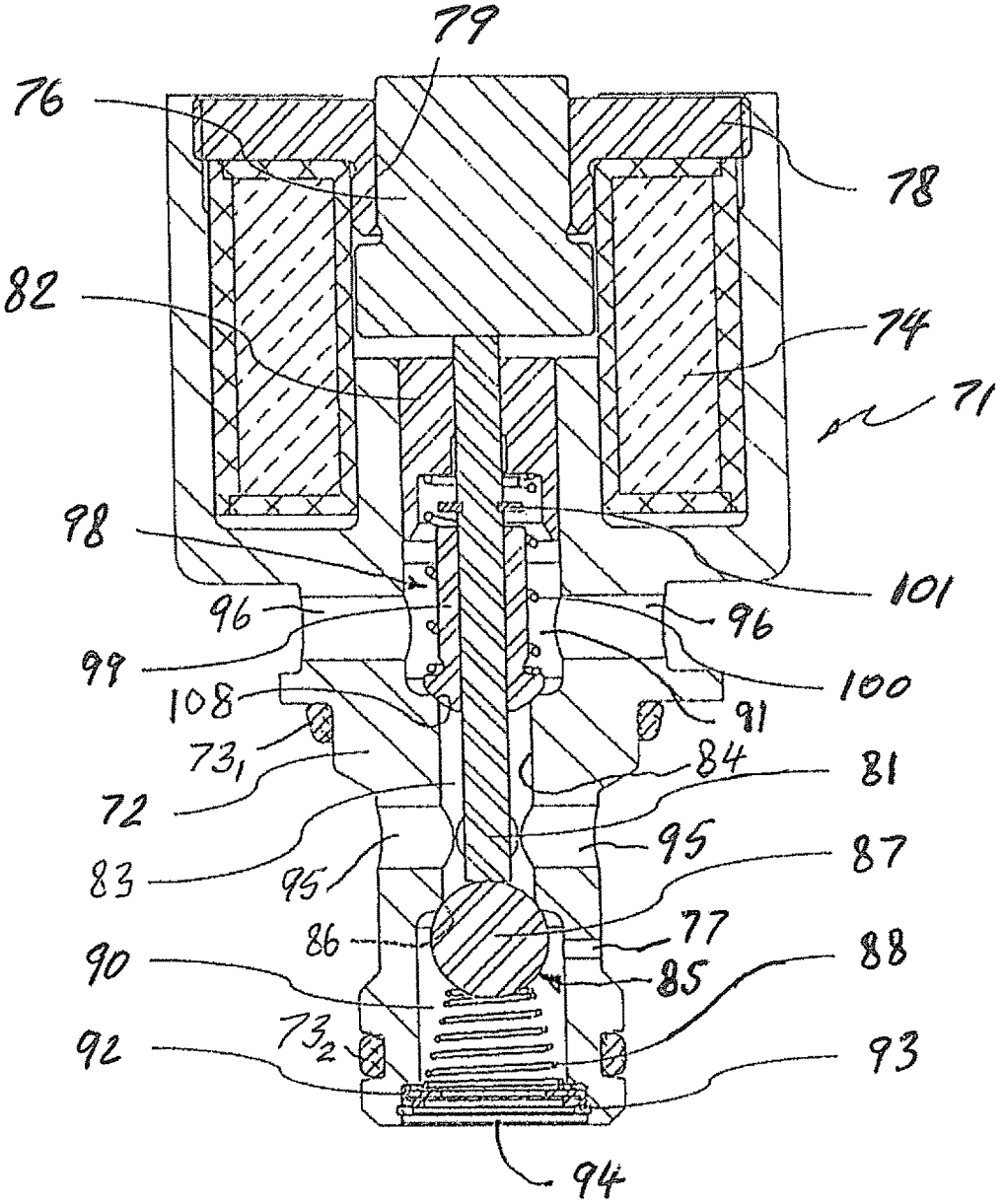
FIG. 7 is a sectional view of the dual stage hydraulic solenoid valve of FIG. 6.

The engine oil in this common supply circuit is pressure regulated, for example by a dual stage hydraulic solenoid valve 71, illustrated in FIGS. 6-8. The hydraulic fluid in the center conduit 272 is maintained at a relatively low pressure to provide the lubricating oil without activating the engine brake, and pressure is increased (on command, such as from a brake-on switch) to a higher oil pressure that will activate the compression-release engine brake system 210 while still providing lubrication oil to the exhaust cam follower 118 and the swivel foot 151. The dual stage hydraulic solenoid valve 71, shown in FIGS. 6-8, controls "brake-on/brake-off" pressurized fluid supply to the compression-release engine brake system 210 in accordance with the third embodiment of the present embodiment. The dual stage hydraulic solenoid valve 71 includes a valve body 72, a solenoid coil 74 disposed in the valve body 72, an armature 76 rectilinearly reciprocating within the solenoid coil 74, and contacts (or terminals) 75 that connect the solenoid coil 74 with a source of an electric power, such as the vehicle battery, to activate the dual stage hydraulic solenoid valve 71.

FIG. 7 shows a sectional view of the dual stage hydraulic solenoid valve 71 shown in FIG. 6. The armature 76 and the solenoid coil 74 are retained in the valve body 72 by a cap 78, which is fixed (i.e., non-moveably attached) to the valve body 72 by appropriate means, such as by a threaded connection. The dual stage hydraulic solenoid valve 71 further includes a solenoid pin 81 and an intake valve 85 disposed in an inlet cavity 90 formed within a distal end of the valve body 72, which is opposite to the cap 78 of the dual stage solenoid valve 71, as best shown in FIG. 7. As also best shown in FIG. 7, the valve body 72 is provided with an upper seal $\mathbf{73}_1$ and a lower seal $\mathbf{73}_2$, both in the form of an O-ring.

The armature 76 rectilinearly reciprocates within the solenoid coil 74 and bore 79 in the cap 78 to selectively engage the solenoid pin 81. The solenoid pin 81 is rectilinearly moveable within bore 84 through the valve body 72 and through pin guide 82, which is disposed inside the bore 84 of the valve body 72 and is fixed to the valve body 72 by appropriate means, such as press fit. The solenoid pin 81 is disposed within the bore 84 of the valve body 72 to selectively open the intake valve 85. The bore 84 leads to an outlet cavity 83 within the valve body 72. As best shown in FIG. 7, the outlet cavity 83 is fluidly connected to the inlet cavity 90 within the distal end of the valve body 72.

The intake valve 85 includes a valve member, such as inlet ball 87 biased towards intake valve seat 86 in the valve body 72 by an inlet spring 88 and by the pressurized hydraulic fluid in the inlet cavity 90. Accordingly, the inlet spring 88 biases the inlet ball 87 towards the closed position of the intake valve 85. The inlet spring 88 is retained within the valve body 72 by inlet screen 92, which also serves as a screen (or plate type) filter for the hydraulic fluid, and a retaining ring 93, such as a C-ring. Thus, the inlet ball 87 is moveable between the closed position of the intake valve 85 when the inlet ball 87 is in contact with the intake valve seat 86, and an open position of the intake valve 85 when the inlet ball 87 is spaced from the intake valve seat 86 to allow fluid communication between the outlet cavity 83 and the inlet cavity 90.

The valve body 72 of the dual stage solenoid valve 71 also includes an intake port 94, an outlet port 95 in fluid communication with the outlet cavity 83, and at least one exhaust port 96 in fluid communication with an exhaust cavity 91. The intake port 94 is located at the distal end of the valve body 72 and connected to the source 105 of pressurized hydraulic fluid. The intake valve 85 is disposed between the intake cavity 90 and the outlet cavity 83.

The dual stage solenoid valve 71 further includes a pressure regulating exhaust valve 98 disposed in the outlet cavity 83 within the valve body 72 between the outlet cavity 83 and the exhaust cavity 91, as best shown in FIG. 7. The pressure regulating exhaust valve 98 includes an exhaust plug 99 rectilinearly moveable toward and away from an exhaust valve seat 108 in the valve body 72. The solenoid pin 81 passes through the exhaust plug 99, and the exhaust plug 99 moves along the solenoid pin 81. The exhaust plug 99 is biased toward the exhaust valve seat 108 by an exhaust spring 100, and is configured to be displaced away from the exhaust valve seat 108 by the pressurized hydraulic fluid in the outlet cavity 83, in order to form the pressure regulating exhaust valve 98. Accordingly, the pressure regulating exhaust valve 98 opens when pressure in the outlet cavity 83 generates a force on the exhaust plug 99 higher than the resilient force of the exhaust spring 100. Thus, the exhaust plug 99 of the pressure regulating exhaust valve 98 is moveable between a closed position when the exhaust plug 99 is in contact with the exhaust valve seat 108, and an open position when the exhaust plug 99 is spaced from the exhaust valve seat 108 to allow fluid communication between the exhaust cavity 91 and the inlet cavity 90.

The solenoid valve 71 further includes an exhaust plug retainer, such as an exhaust plug circlip (or C-clip) 101 attached to the solenoid pin 81. The exhaust plug circlip 101 is driven by the solenoid pin 81 against the exhaust plug 99 to increase the holding force applied against the exhaust valve seat 108, thus allowing an increase of the hydraulic fluid pressure in the outlet cavity 83.

As illustrated in FIG. 7, the solenoid pin 81 is disposed between the armature 74 and the inlet ball 87 to selectively engage the inlet ball 87, and move the inlet ball 87 away from the valve seat 86 toward the open position of the intake valve 85. Specifically, when the solenoid coil 74 is de-energized (i.e., in a de-energized state), the inlet spring 128 and the pressurized hydraulic fluid in the inlet cavity 90 bias the inlet ball 87 toward the closed position of the intake valve 85. However, when the solenoid coil 74 of the solenoid valve 71 is energized (i.e., in an energized state), the armature 76 moves downwardly toward the intake valve 85 and pushes the solenoid pin 81 downward, which, in turn, displaces the inlet ball 87 away from the intake valve seat 86 toward the open position, and thus allows fluid communication between the outlet cavity 83 and the inlet cavity 90.

FIG. 8 shows an exemplary installation of the solenoid valve 71 of FIG. 6 mounted to a hydraulic manifold 101. Specifically, a distal end of the valve body 72 is disposed within the hydraulic manifold 101 through the upper seal $\mathbf{73}_1$ and the lower seal $\mathbf{73}_2$ so as to seal the solenoid valve 71 to the surrounding hydraulic manifold 101. The hydraulic fluid flows into the inlet cavity 90 from an inlet port 106 of the hydraulic manifold 101 and is prevented from entering the outlet cavity 83 of the solenoid valve 71 by the inlet ball 87 and the lower seal $\mathbf{73}_2$. The inlet port 106 of the hydraulic manifold 101 is fluidly connected to the source 105 of the pressurized hydraulic fluid. The source 105, according to the exemplary embodiment, is a hydraulic fluid pump, such as an engine oil pump of the diesel engine 1. Correspondingly, in the exemplary embodiment, engine lubricating oil is used as the working hydraulic fluid stored in hydraulic fluid sump 107, best shown in FIG. 8. It will be appreciated that other appropriate sources of the pressurized hydraulic fluid and any other appropriate type of fluid will be within the scope of the present invention.

A bypass port 77 in the valve body 72 communicates with the intake valve 85 and allows a portion of the hydraulic fluid to move into the outlet cavity 83 while the inlet ball 87 of the intake valve 85 is in the closed position. The hydraulic fluid is prevented from flowing from the outlet cavity 83 through the exhaust cavity 91 to the exhaust port 96 by the exhaust plug 99 of the pressure regulating exhaust valve 98 and by the upper seal $\mathbf{73}_1$ until the exhaust plug 99 moves away from the exhaust valve seat 108. The outlet cavity 83 is fluidly connected to the outlet port 95, which supplies pressurized hydraulic fluid to downstream components, such as the supply conduit 220 of the exhaust rocker assembly 212, through an outlet port 108 of the hydraulic manifold 101. The exhaust cavity 91 is fluidly connected to the hydraulic fluid sump 107 by the exhaust port 96, as best shown in FIG. 8. In other words, the hydraulic fluid (such as motor oil) returns (drains back) to the hydraulic fluid sump 107 from the exhaust cavity 91 above the exhaust plug 99 through the one or more exhaust ports 96.

The dual-stage solenoid valve 71 is configured to provide two stages of hydraulic pressure in the outlet cavity 83 of the solenoid valve 71: a low-pressure stage and a full inlet pressure (or high-pressure) stage. The two stages of hydraulic pressure in the outlet cavity 83 are controlled by an inlet pressure generated by the source 105 of the pressurized hydraulic fluid, the size of the bypass port 77 in the valve body 72, and the force exerted by the exhaust spring 100 on the exhaust plug 99. In the low-pressure stage, the solenoid coil 74 is de-energized (not energized), the inlet ball 87 is seated on the intake valve seat 86 of the valve body 72 (i.e., in the closed position) and the pressurized hydraulic fluid in the outlet cavity 83 is delivered by the bypass port 77, thus providing a low (or first) inlet pressure hydraulic fluid to the center conduit 272 in the exhaust rocker arm 214. The hydraulic pressure in the outlet cavity 83 is regulated by the elastic force of the exhaust spring 100 on the exhaust plug 99. The bypass port 77 provides sufficient flow of the pressurized hydraulic fluid to satisfy downstream requirements, while preventing an excess of the hydraulic fluid flow from being exhausted and causing a decrease in the inlet pressure. When the solenoid coil 74 is energized (i.e., when electrical power is supplied to the electrical contacts 75), an electromagnetic force displaces the armature 76 toward the solenoid pin 81, driving the exhaust plug retainer 101 toward the exhaust plug 99 and upsetting the inlet ball 87 from the intake valve seat 86 of the valve body 72 (i.e., to the open position). This increases the seating force on the exhaust plug 99 to a force that the inlet pressure is unable to overcome (thus, retaining the pressure regulating exhaust valve 98 in the closed position), allowing for the high-pressure stage in the outlet cavity 83, thus providing full (or second) inlet pressure hydraulic fluid. The full (or second) inlet pressure of the hydraulic fluid is higher than the low (or first) inlet pressure of the hydraulic fluid.

The overall engine brake-on/brake-off operation is described hereafter.

The exhaust cam (not shown) pivots the exhaust rocker arm 214 towards the valve bridge 104 to open and close the exhaust valves $\mathbf{2}_1$ and $\mathbf{2}_2$ during a normal exhaust stroke. After the conclusion of normal exhaust motion, the exhaust cam profile moves away from the exhaust cam follower 118, allowing the exhaust cam follower 118 to move (pivot or rotate) away from the valve bridge 104. The slider screw assembly 150 lengthens under the force of the slider spring 152 to pivot the exhaust rocker arm 214 towards the exhaust cam, maintaining the exhaust cam follower 118 in contact with the exhaust cam as it moves away.

The exhaust cam drives the exhaust rocker arm 214 towards the valve bridge 104 near TDC of the compression stroke. This oscillating motion of the exhaust rocker arm 214 is not transmitted to the exhaust valves $\mathbf{2}_1$ and $\mathbf{2}_2$ during the normal (or positive power) engine operation (or the brake-off mode of the lost motion compression-release engine brake system 210), i.e., it is motion "lost" to the valves.

A method of operating the compression-release brake system 210 for operating at least one exhaust valve $\mathbf{2}_1$ of an internal combustion engine during a compression-release engine braking operation is as follows. First, the dual stage hydraulic solenoid valve 71 is opened to supply the full inlet pressure hydraulic fluid from the source 105 of pressurized hydraulic fluid through the center conduit 272 and the brake fluid passageway 220 to the compression brake control module 22 so as to extend the actuation piston 26 and hydraulically close the reset check valve 35 during the braking operation mode of the engine. In other words, the reset check valve 35 is biased closed when the pressurized hydraulic fluid is supplied from the compression brake fluid passageway 220 to the CBCM 22 to extent the hollow activation piston 26 and hydraulically activate the compression brake actuator 30 during a braking operation mode of the internal combustion engine. Next, the reset check valve 35 is hydraulically biasing closed during a valve brake lift of the at least one exhaust valve $\mathbf{2}_1$. As a result, the reset check valve 35 is biased open and allows retraction of the hollow activation piston 26 during a positive power operation mode of the engine. Consequently, the at least one exhaust valve $\mathbf{2}_1$ is reset by opening the reset check valve 35 and releasing hydraulic fluid from the actuation piston cavity 42 to close the at least one exhaust valve $\mathbf{2}_1$.

Then, the dual stage hydraulic solenoid valve 71 is closed to supply the low inlet pressure hydraulic fluid from the source 105 of pressurized hydraulic fluid through the center conduit 272 and the brake fluid passageway 220 to the compression brake control module 22 so as to open the reset check valve 35 thereby allowing retraction the actuation piston 26 during a positive power operation mode of the engine. Consequently, the at least one exhaust valve $\mathbf{2}_1$ is reset by opening the reset check valve 35 and releasing hydraulic fluid from the actuation piston cavity 42 to close the at least one exhaust valve $\mathbf{2}_1$.

Alternatively, the overhead exhaust cam follower 118 may be substituted with a cam-in-block push tube assembly, and the function of the lost motion compression-release engine brake system 210 as otherwise disclosed will be retained. It will also be evident that a valve bridge pin through the valve bridge 104, as shown in FIG. 1, may be implemented in the compression-release brake system according to the third exemplary embodiment to control contact pressures at the interface between the braking exhaust valve $\mathbf{2}_1$, the valve bridge 104, and the CBCM 22 without compromise of function as disclosed in the third exemplary embodiment.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

We claim:

1. A compression-release brake system for operating at least one exhaust valve of an internal combustion engine during a compression-release engine braking operation, the compression-release system comprising a lost motion exhaust rocker assembly and a dual stage hydraulic solenoid valve;

the lost motion exhaust rocker assembly comprising:

an exhaust rocker arm; and a self-contained compression brake control module mounted to the exhaust rocker arm and operatively coupled to the at least one exhaust valve so as to control a lift and a phase angle of the at least one exhaust valve, the compression brake control module maintaining the at least one exhaust valve open during a compression stroke of the internal combustion engine when in the compression-release engine braking operation;

the compression brake control module comprising:

a hollow casing including a single-piece body mounted in the exhaust rocker arm, the casing defining an internal actuator cavity, and a hollow inner portion extending away from the internal actuator cavity;

a hollow actuation piston disposed outside the casing and in the exhaust rocker arm so as to receive the inner portion, the actuation piston defining a variable volume hydraulic actuation piston cavity between the casing and the actuation piston, the actuation piston reciprocating relative to the inner portion between an extended position and a collapsed position, the actuation piston configured to engage the at least one exhaust valve when in the extended position;

a connecting passage arranged in the casing so as to fluidly connect the actuation piston cavity to the internal actuator cavity;

a reset check valve arranged between the connecting passage and the actuation piston cavity, the reset check valve configured to hydraulically lock the actuation piston cavity when a pressure of hydraulic fluid within the actuation piston cavity exceeds a pressure of hydraulic fluid in a supply port formed in the casing, the reset check valve biased closed via a biasing spring;

a compression brake actuator slidably arranged in the internal actuator cavity so as to control the reset check valve, the compression brake actuator including a control piston exposed to ambient pressure, the control piston configured to reciprocate between an extended position and a retracted position; and a control piston spring biasing the control piston toward the extended position in which the control piston engages and opens the reset check valve solely via a biasing force of the control piston spring so as to unlock the actuation piston cavity and fluidly connect the actuation piston cavity to the supply port;

the dual stage hydraulic solenoid valve configured for controlling hydraulic pressure in the compression brake control module and including:

a valve body having an intake port, an outlet port and an exhaust port;

a solenoid coil disposed in the valve body;

an armature rectilinearly reciprocating within the solenoid coil;

a solenoid pin rectilinearly reciprocating within valve body and operatively associated with the armature;

an intake valve disposed between the intake port and the outlet port; and a pressure regulating exhaust valve disposed between the outlet port and the exhaust port;

wherein the actuation piston includes an inner peripheral surface defining a groove, and a retaining ring mounted to the groove, wherein the inner portion includes an outer peripheral surface defining an inner stopping surface, wherein the retaining ring is configured to engage the inner stopping surface so as to stop movement of the actuation piston relative to the casing when the actuation piston reaches the extended position when the retaining ring engages the inner stopping surface, and wherein a pressurized hydraulic fluid supplied to the valve body through the intake port is regulated so as to flow through both the outlet port and the exhaust port via the pressure regulating exhaust valve when the solenoid coil is in a de-energized state and, when the solenoid coil is in an energized state, the pressure regulating exhaust valve is closed and the intake valve is opened so as to supply the pressurized hydraulic fluid only to the outlet port.

2. The compression-release brake system as defined in claim 1, wherein the exhaust rocker arm is provided with a center conduit fluidly connected to a source of pressurized hydraulic fluid.

3. The compression-release brake system as defined in claim 2, wherein the exhaust rocker arm is formed with a brake fluid passageway fluidly connected to the center conduit of the exhaust rocker arm to selectively supply the pressurized hydraulic fluid to the hydraulically actuated compression brake control module from the source of the pressurized hydraulic fluid by the dual stage solenoid valve.

4. The compression-release brake system as defined in claim 3, wherein the supply port of the exhaust rocker arm assembly is fluidly connected to the brake fluid passageway formed in the exhaust rocker arm, and wherein the supply port is configured to provide the pressurized hydraulic fluid to the actuation piston cavity via the connecting passage.

5. A method of operating the compression-release brake system of claim 3, the method comprising the steps of:

opening the dual stage hydraulic solenoid valve to supply a full inlet pressure hydraulic fluid from the source of pressurized hydraulic fluid through the center conduit and the brake fluid passageway to the compression brake control module so as to extend the actuation piston and hydraulically close the reset check valve during a braking operation mode of the engine; and closing the dual stage hydraulic solenoid valve to supply a low inlet pressure hydraulic fluid from the source of pressurized hydraulic fluid through the center conduit and the brake fluid passageway to the compression brake control module so as to open the reset check valve thereby retracting the actuation piston during a positive power operation mode of the engine.

6. The compression-release brake system as defined in claim 4, wherein the lost motion exhaust rocker assembly further comprises a slider screw assembly mounted to the lost motion exhaust rocker arm and operatively coupled to the at least one exhaust valve via an exhaust valve bridge.

7. The compression-release brake system as defined in claim 6, wherein the exhaust rocker arm is configured to continuously deliver lubrication to the slider screw assembly via a lubrication channel formed in the lost motion exhaust rocker arm, and wherein the lubrication channel is fluidly connected to the brake fluid passageway through the supply port of the compression brake control module.

8. The compression-release brake system as defined in claim 6, wherein the slider screw assembly is centered above the exhaust valve bridge.

9. The compression-release brake system as defined in claim 6, wherein both the slider screw assembly and the self-contained compression brake control module are mounted to a first distal end of the lost motion exhaust rocker arm.

10. The compression-release brake system as defined in claim 1, wherein the exhaust rocker arm is configured to continuously deliver lubrication to an exhaust cam follower via a lubrication conduit formed in the exhaust rocker arm.

11. The compression-release brake system as defined in claim 1, wherein the lost motion exhaust rocker arm is pivotally mounted about an engine rocker shaft and configured to open the at least one exhaust valve through an exhaust valve bridge.

12. The compression-release brake system as defined in claim 1, wherein the exhaust rocker arm includes a control bore configured to receive the actuation piston so as to define the actuation piston cavity, and wherein the actuation piston reciprocates in the control bore.

13. The compression-release brake system as defined in claim 12, wherein the single-piece body includes a partially threaded outer cylindrical surface configured to engage the control bore in the exhaust rocker arm.

14. The compression-release brake system as defined in claim 12, wherein the actuation piston further includes an outer seal and a smooth outer surface configured to engage, seal against, and reciprocate within the control bore.

15. The compression-release brake system as defined in claim 1, wherein the inner portion separates the internal actuator cavity from the actuation piston cavity, and wherein the connecting passage is formed in the inner portion.

16. The compression-release brake system as defined in claim 1, wherein the control piston includes a bottom face exposed to the hydraulic fluid, and a top face exposed to ambient pressure.

17. The compression-release brake system as defined in claim 16, wherein the actuator cavity is closed with an end cap including a vent port.

18. The compression-release brake system as defined in claim 1, wherein the control piston includes:

a bottom face configured to engage a control piston seat when the control piston is in the extended position, and a top face configured to engage an end cap which closes the internal actuator cavity when the control piston is in the retracted position.

19. The compression-release brake system as defined in claim 1, wherein the control piston spring is disposed within the casing between the control piston and an end cap.

* * * * *